US006578538B2

(12) United States Patent
Trentham

(10) Patent No.: US 6,578,538 B2
(45) Date of Patent: Jun. 17, 2003

(54) ROTARY VALVE FOR PISTON ENGINE

(76) Inventor: O. Paul Trentham, 7342 Old Scenic Dr., Neosho, MO (US) 64850

( * ) Notice: Subject to any disclaimer, the term of this patent is extended or adjusted under 35 U.S.C. 154(b) by 0 days.

(21) Appl. No.: 09/825,523

(22) Filed: Apr. 2, 2001

(65) Prior Publication Data

US 2002/0139342 A1 Oct. 3, 2002

(51) Int. Cl.[7] ..... F01L 7/14; F01L 7/16
(52) U.S. Cl. ..... 123/190.2; 123/190.17
(58) Field of Search ..... 123/80 R, 80 BA, 123/80 C, 80 D, 190.1, 190.12, 190.4, 190.5, 190.6, 190.8, 190.11, 190.14, 190.2, 190.17; 251/304, 310, 314

(56) References Cited

U.S. PATENT DOCUMENTS

| | | | | | |
|---|---|---|---|---|---|
| 3,650,295 | A | | 3/1972 | Smith | 137/614.17 |
| 3,948,227 | A | * | 4/1976 | Guenther | 123/190.2 |
| 3,993,036 | A | * | 11/1976 | Tischler | 123/190.1 |
| 4,019,487 | A | | 4/1977 | Guenther | 123/190.17 |
| 4,333,427 | A | * | 6/1982 | Burillo et al. | 123/190.17 |
| 4,421,077 | A | * | 12/1983 | Ruggeri | 123/190.8 |
| 4,506,636 | A | | 3/1985 | Negre | 123/190.2 |
| 4,574,749 | A | | 3/1986 | Negre | 123/80 R |
| 4,788,945 | A | | 12/1988 | Negre | 123/190.8 |
| 4,944,261 | A | | 7/1990 | Coates | 123/190.14 |
| 4,949,686 | A | * | 8/1990 | Brusutti | 123/190.17 |
| 4,953,527 | A | | 9/1990 | Coates | 123/190.4 |
| 4,976,232 | A | * | 12/1990 | Coates | 123/190.17 |
| 4,989,558 | A | | 2/1991 | Coates | 123/190.14 |
| 4,989,576 | A | | 2/1991 | Coates | 123/80 D |
| 5,109,814 | A | | 5/1992 | Coates | 123/190.14 |
| 5,152,259 | A | | 10/1992 | Bell | 123/190.2 |
| 5,205,251 | A | * | 4/1993 | Conklin | 123/190.8 |

(List continued on next page.)

OTHER PUBLICATIONS

Setright, L.J.K. "Some Unusual Engines," Mechanical Engineering Publication Ltd., pp. 47–71 (1975).

Heinz Heisler, "Advanced Engine Technology", SAE International, front and back cover and pp iii, iv, 1–14 and 757–770 (1995).

Ray T. Bohacz, "Look Mom, No Camshaft!", Popular Hot Rodding, pp. 70–74 (Oct. 1999).

Takumi Muroki, et al., "A Study of Rotary Valve for a Single Cylinder Engine"; SAE International, SAE 199–01–3322, JSAE 9938077, pp. 1–9 (1999).

Robert Q. Riley, "Alternative Cars in the 21st Century", SAE International, front and back cover, publication page, and pp. 123–137, 154–156 (1994).

John B. Heywood, et al., "The Two–Stroke Cycle Engine: Its Development, Operation, and Design", SAE International, front and back cover and pp. iv and 164–166 (1999).

*Primary Examiner*—Willis R. Wolfe
(74) *Attorney, Agent, or Firm*—Hovey Williams LLP

(57) ABSTRACT

A rotary valve assembly for an internal combustion engine includes a rotatable tubular valve body having a pair of diametrically opposed fluid flow holes that are intermittently aligned with the intake and inlet port of the cylinder as the body rotates. The valve assembly is consequently closed and generally blocks fluid flow to the cylinder when the holes of the valve body are not aligned with the intake and inlet port. The valve assembly includes a valve timing adjuster for permitting selective adjustment of the time during which the valve is open. The timing adjuster includes an inner cylindrical core and an intermediate sleeve positioned concentrically between the core and valve body. The core has a diametrically extending flow-through opening and the intermediate sleeve has a pair of diametrically opposed apertures. The engine is preferably provided with a similar rotary valve assembly in the exhaust. A unique rotary valve seal is also disclosed.

32 Claims, 11 Drawing Sheets

U.S. PATENT DOCUMENTS

| | | | | | |
|---|---|---|---|---|---|
| 5,214,886 | A | | 6/1993 | Hugron | 52/98 |
| 5,251,591 | A | | 10/1993 | Corrin | 123/190.6 |
| 5,361,739 | A | | 11/1994 | Coates | 123/190.14 |
| 5,535,715 | A | | 7/1996 | Mouton | 123/197.1 |
| 5,592,904 | A | | 1/1997 | Negre | 123/52.3 |
| 5,601,405 | A | | 2/1997 | Coates | 415/202 |
| 5,690,069 | A | * | 11/1997 | Huwarts | 123/190.2 |
| 5,706,775 | A | | 1/1998 | Schweter et al. | 123/190.12 |
| 5,711,265 | A | | 1/1998 | Duve | 123/190.2 |
| 5,724,926 | A | | 3/1998 | Wilke | 123/80 BA |
| 5,738,051 | A | | 4/1998 | Binversie et al. | 123/80 BA |
| 5,941,206 | A | | 8/1999 | Smith et al. | 123/190.4 |
| 6,308,677 | B1 | | 10/2001 | Bohach et al. | 123/190.1 |
| 6,390,048 | B1 | * | 5/2002 | Luchansky | 123/190.1 |

* cited by examiner

ROTARY VALVE FOR PISTON ENGINE

BACKGROUND OF THE INVENTION

1. Field of the Invention

The present invention relates generally to reciprocating or piston engines (e.g., Rankine engines, internal combustion engines, etc.). More particularly, the present invention concerns a rotary valve assembly used to control intake and exhaust fluid flow to and from the cylinder(s) of the engine. The present invention also particularly concerns a seal for the rotary valve.

2. Discussion of Prior Art

Generally speaking, internal combustion engines traditionally include poppet valves for controlling fluid flow to and from each cylinder. Those ordinarily skilled in the art will appreciate that poppet valves rely on reciprocating valve stem movement to effect valve opening and closing. Such a configuration requires a complex drive for controlling valve stem movement (e.g., a camshaft). Furthermore, reciprocating valve and valve drive mechanism movement inherently involves cyclical, fatiguing operation. It is also known that poppet valves are particularly susceptible to wear and degradation caused by heat, which is attributable to certain components of the valve being continuously exposed to the chamber. Yet further, certain engine manufacturers have recognized the advantages of variable valve timing (e.g., increasing efficiency over a greater range of engine operation); however, variable valve timing with poppet valves has required expensive and complex valve drive arrangements. One such arrangement comprises a complex variable tension chain drive that is further deficient in the sense that it fails to provide significant flexibility in varying the valve timing.

In an apparent attempt to address the problems associated with poppet valves, there have been internal combustion engines provided with rotary valves that rotate in a single direction during engine operation to alternately block or permit flow along the intake or exhaust. It will be appreciated that the rotary valve is consequently not subjected to the fatigue problems often associated with a poppet valve. Furthermore, the rotating valve may be arranged so that no part thereof is continuously exposed to the chamber such that the risk of heat-caused wear and degradation is virtually eliminated. However, rotary valves for internal combustion engines have heretofore been very complex in construction. Furthermore, conventional rotary valves are believed to create high flow losses, thereby inhibiting flow to or from the engine. In addition, conventional rotary valves have not been provided with timing controls, and internal combustion engines having rotary valves therefore fail to provide variable valve timing.

It is noted that rotary valves have also been developed for other types of reciprocating engines, such as Rankine engines. Although some of these valves have been provided with timing controls, they too create high losses and consequently reduce engine efficiency.

OBJECTS AND SUMMARY OF THE INVENTION

Responsive to these and other problems, an important object of the present invention is to provide an improved rotary valve for a reciprocating engine. It is particularly an important object of the present invention to provide a rotary valve for a reciprocating engine, wherein the valve creates negligible flow losses and is simple, durable and inexpensive in construction. Another important object of the present invention is to provide a rotary valve having infinitely variable timing controls. It is also an important object of the present invention to provide an internal combustion engine that does not utilize poppet valves and permits variability of valve timing.

In accordance with these and other objects evident from the following description of the preferred embodiments, the present invention concerns a reciprocating engine including a body that presents an internal chamber and a fluid intake through which fluid flows to the chamber. Oscillating within the chamber during engine operation is a piston, and a rotary valve assembly fluidly disposed along the intake serves to generally block fluid flow to the chamber when closed and permit fluid flow to the chamber when open. The valve assembly presents a generally linear fluid flow passageway extending through the valve assembly, with the passageway being generally aligned and communicating with the intake when the valve assembly is open. The valve includes a rotatable valve body operable to intermittently block fluid flow through the passageway and thereby close the valve assembly as the valve body rotates. The valve assembly further includes a valve timing adjuster that is shiftable into and out of a variable flow-obstructing relationship with the passageway so as to vary the time during which the valve body blocks flow through the passageway.

The valve assembly preferably includes a cylindrical sleeve element and a cylindrical core element located concentrically within the sleeve. The cylindrical sleeve element presents diametrically opposed holes and the core element includes a diametrically extending surface that defines a diametrical flow-through opening. The holes and opening cooperatively define, when aligned, a generally linear fluid flow passageway through the valve assembly that is generally aligned with the intake when the valve assembly is open. One of the elements is rotatable during engine operation to intermittently block flow through the passageway and thereby close the valve assembly. Most preferably, the sleeve element comprises the rotating valve body and the core element is part of the valve timing adjuster. The present invention also concerns the valve assembly apart from the engine.

In addition, the present invention concerns a rotary valve seal assembly for providing sealed communication between the fluid flow opening in the rotatable cylindrical outer face of the valve assembly and a fluid flow port in the engine body. The valve assembly includes a pair of radially projecting flanges that extend continuously around the outer face with the opening located therebetween. The seal assembly includes a pair of elongated longitudinal seals extending longitudinally along the outer face of the valve assembly between the flanges and being generally fixed relative to the stationary surface with the fluid flow port being located therebetween. The longitudinal seals sealingly engage the outer face of the valve and the flanges. The seal assembly further includes a pair of arcuately shaped circumferential seals fixed relative to the stationary surface. The circumferential seals each sealingly engage a respective one of the flanges between the longitudinal seals. Finally, the inventive seal assembly includes a plurality of juncture seals each sealingly interconnected between a respective one of the longitudinal seals and a respective one of the circumferential seals, such that the seals cooperatively seal between the outer face and the stationary surface in a circumscribing relationship with the fluid flow port.

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein.

Figure 2:
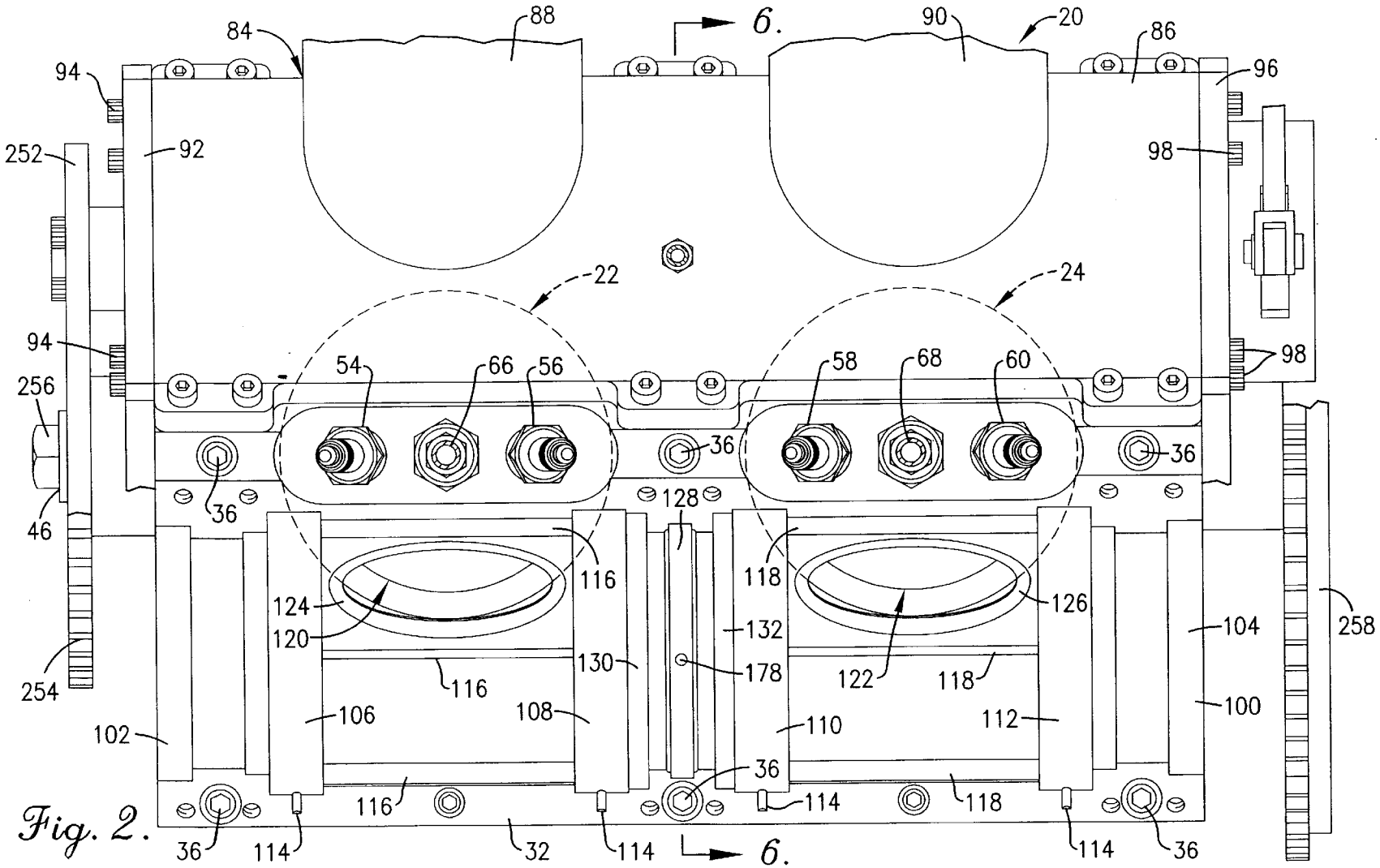
FIG. 2 is a fragmentary plan view of the engine, with the intake manifold being removed to illustrate details of the engine body.
Figure 5:
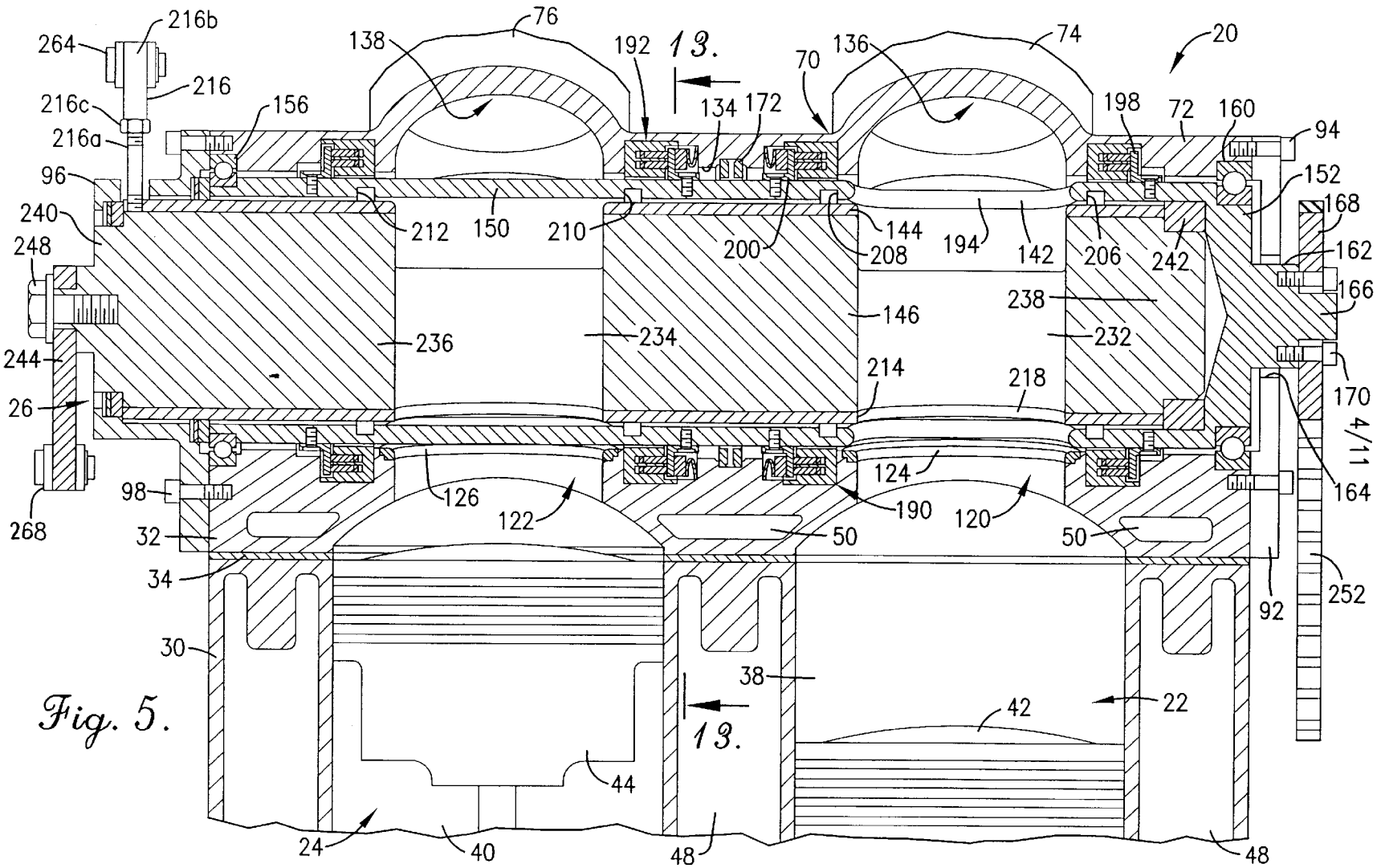
FIG. 5 is a cross-sectional view of the engine taken generally along line 5—5 of FIG. 4, particularly illustrating portions of the seal and bearing arrangements for the intake valve assembly.
Figure 5A:
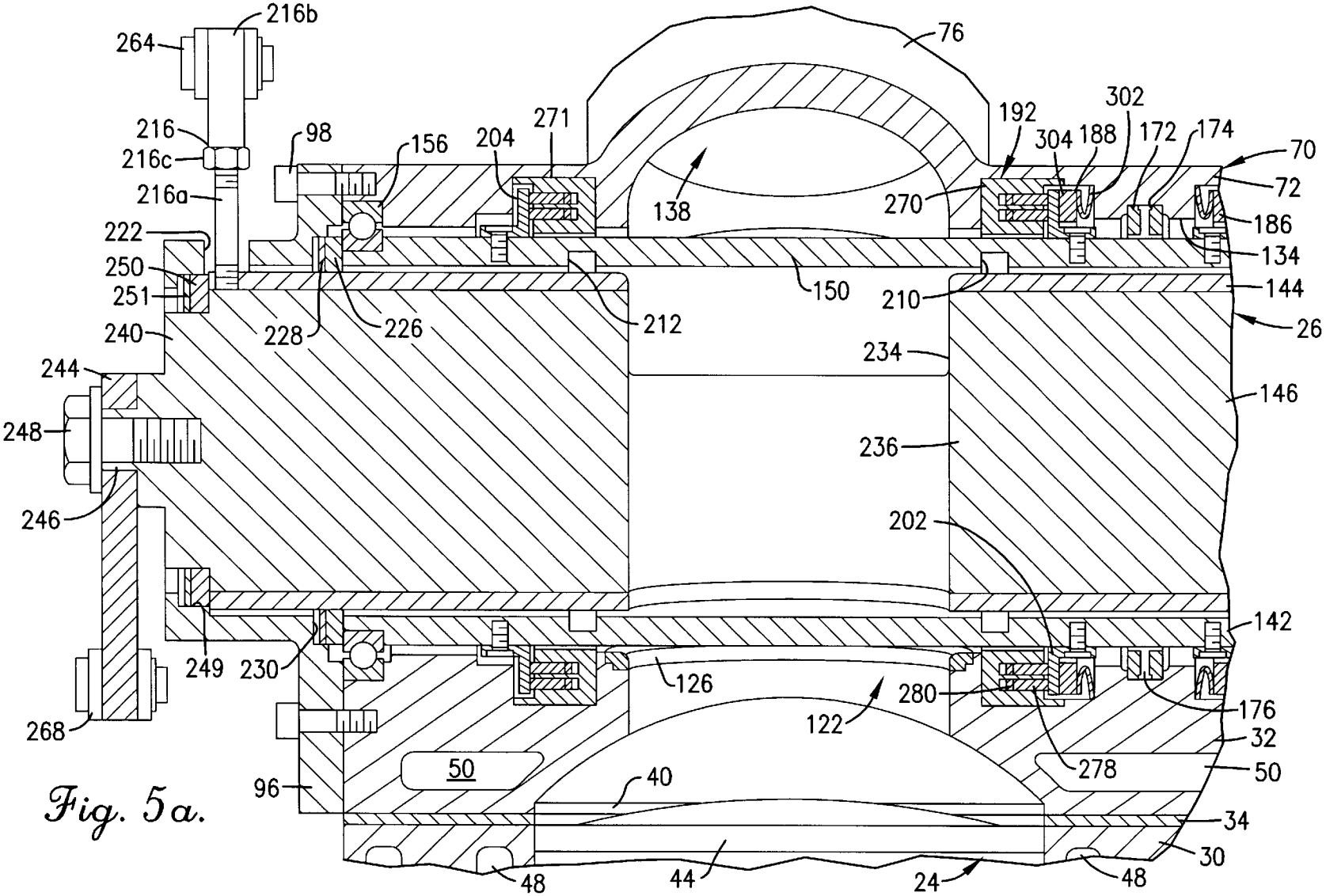
Figure 6:
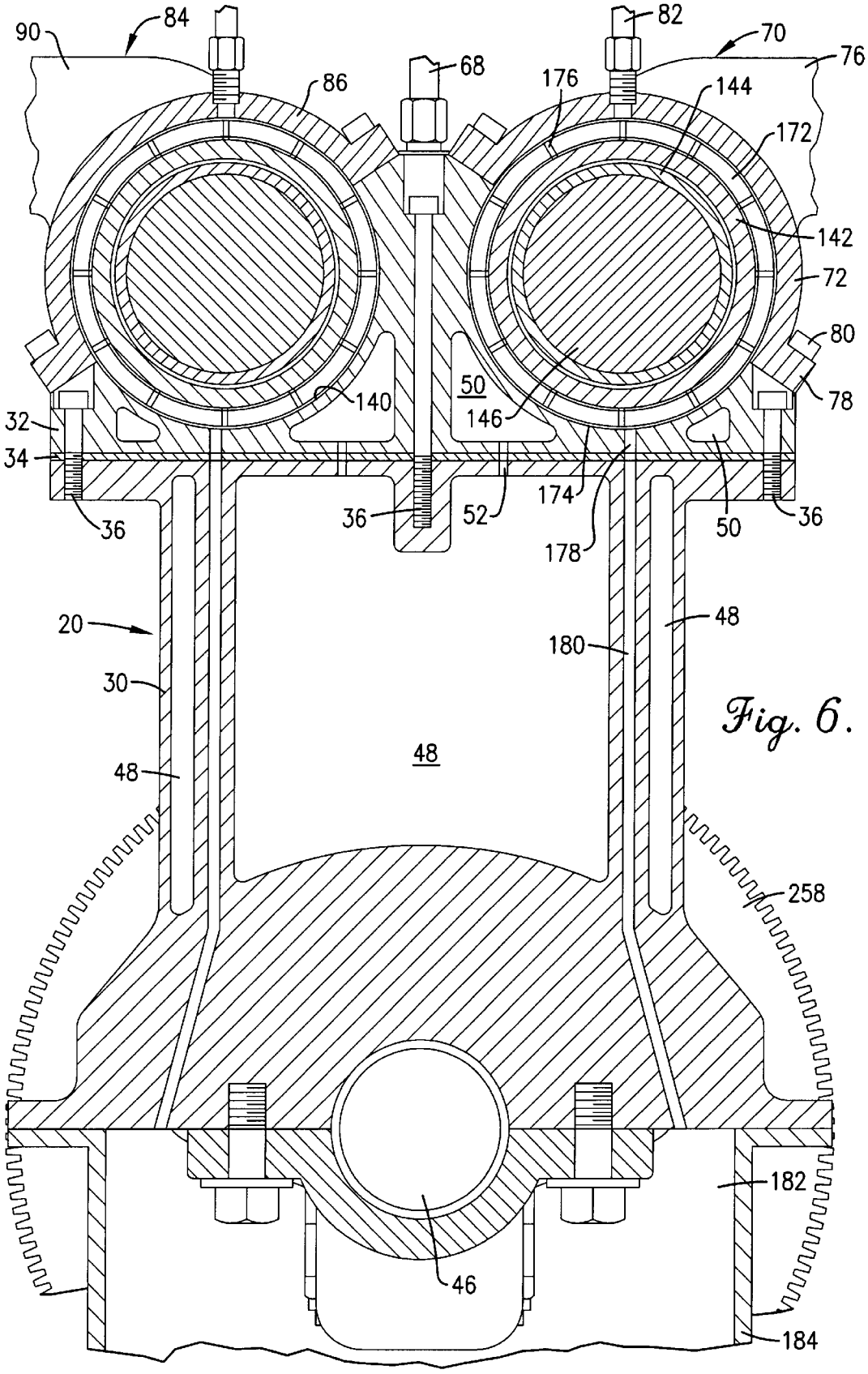
Figure 7:
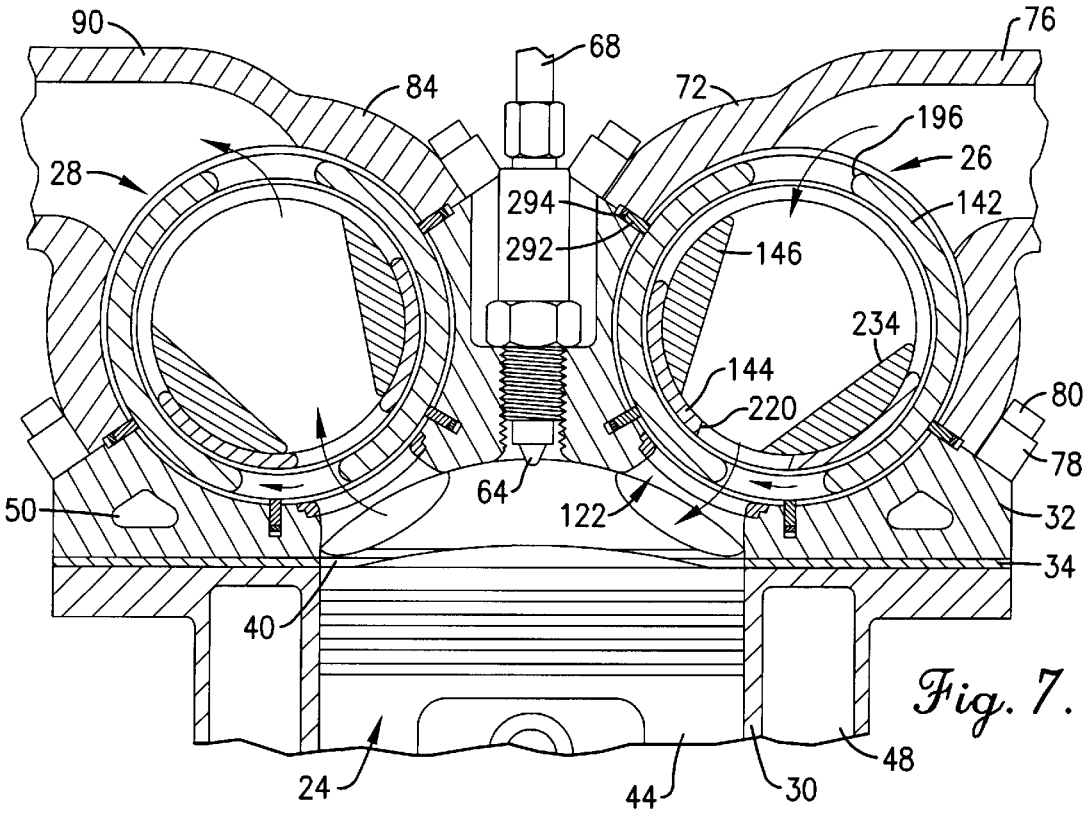
Figure 8:
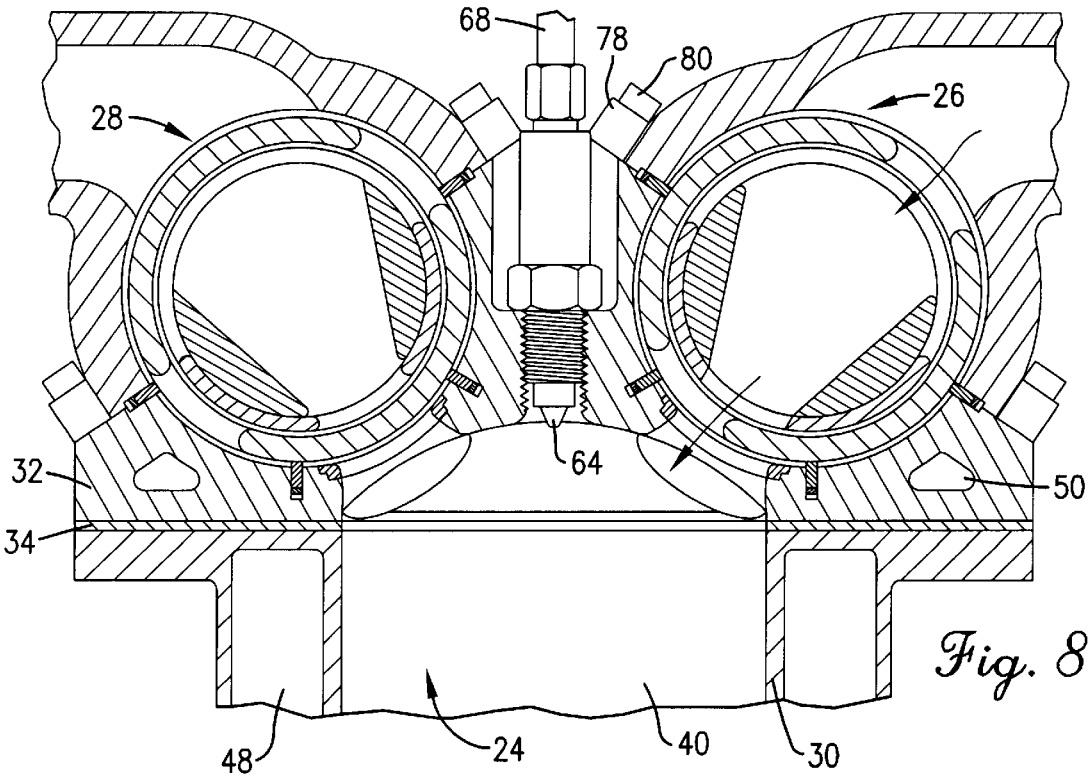
Figure 9:
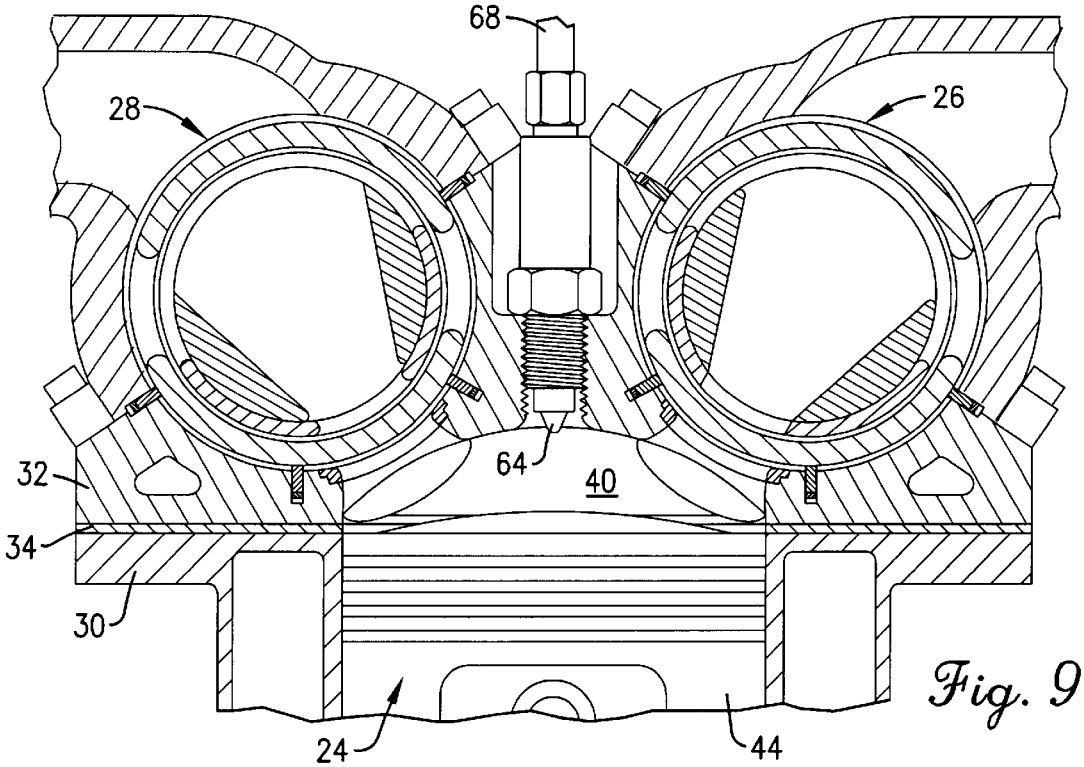
Figure 10:
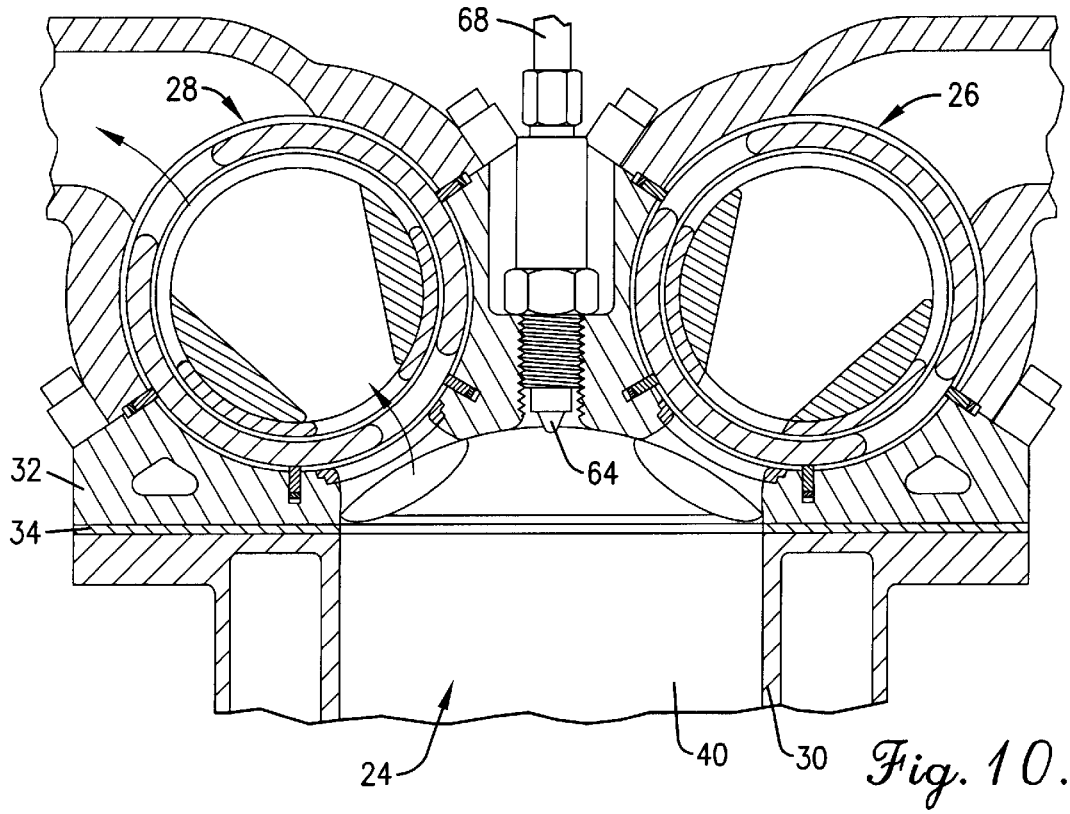
Figures 11, 11A:
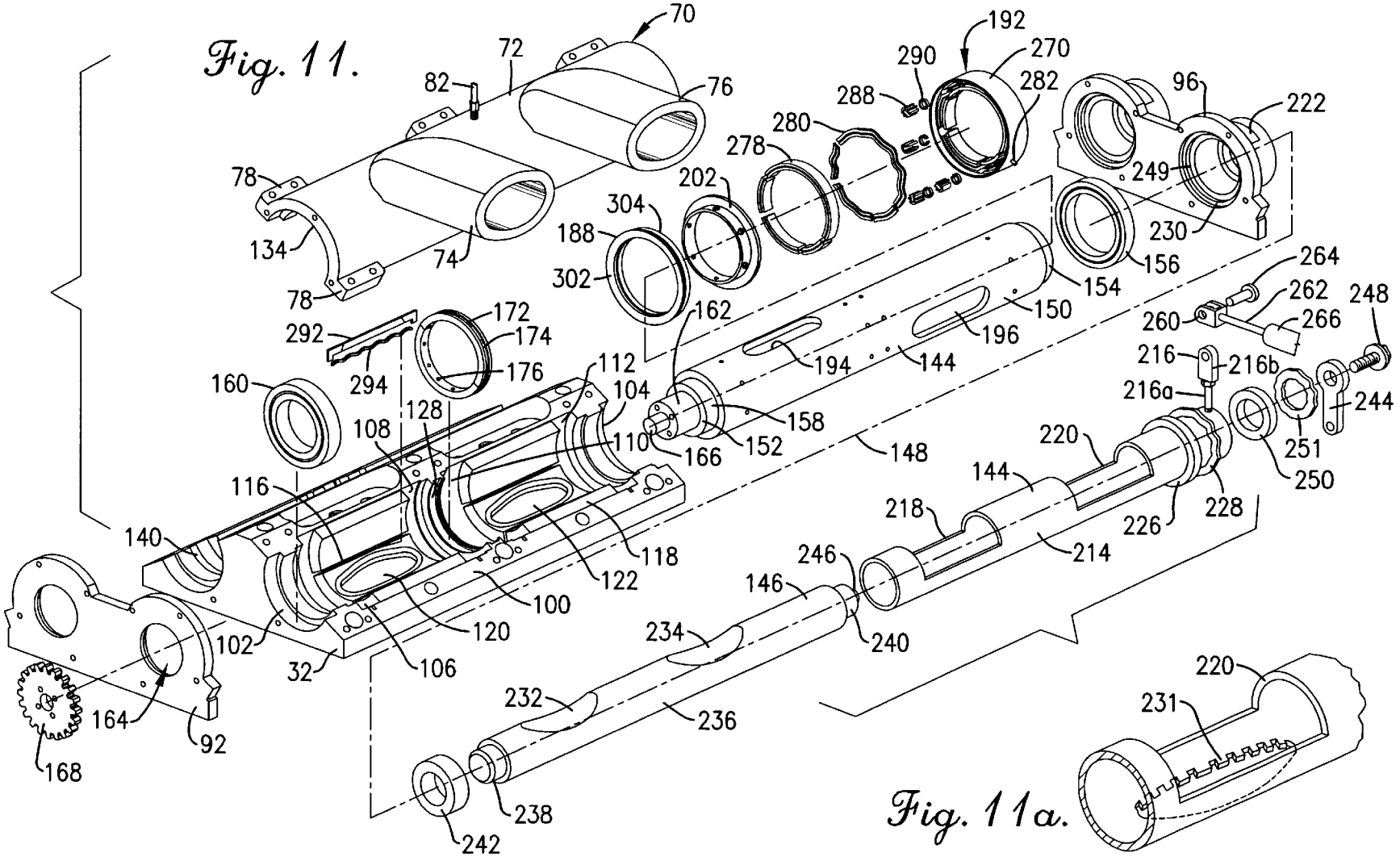
Figure 12:
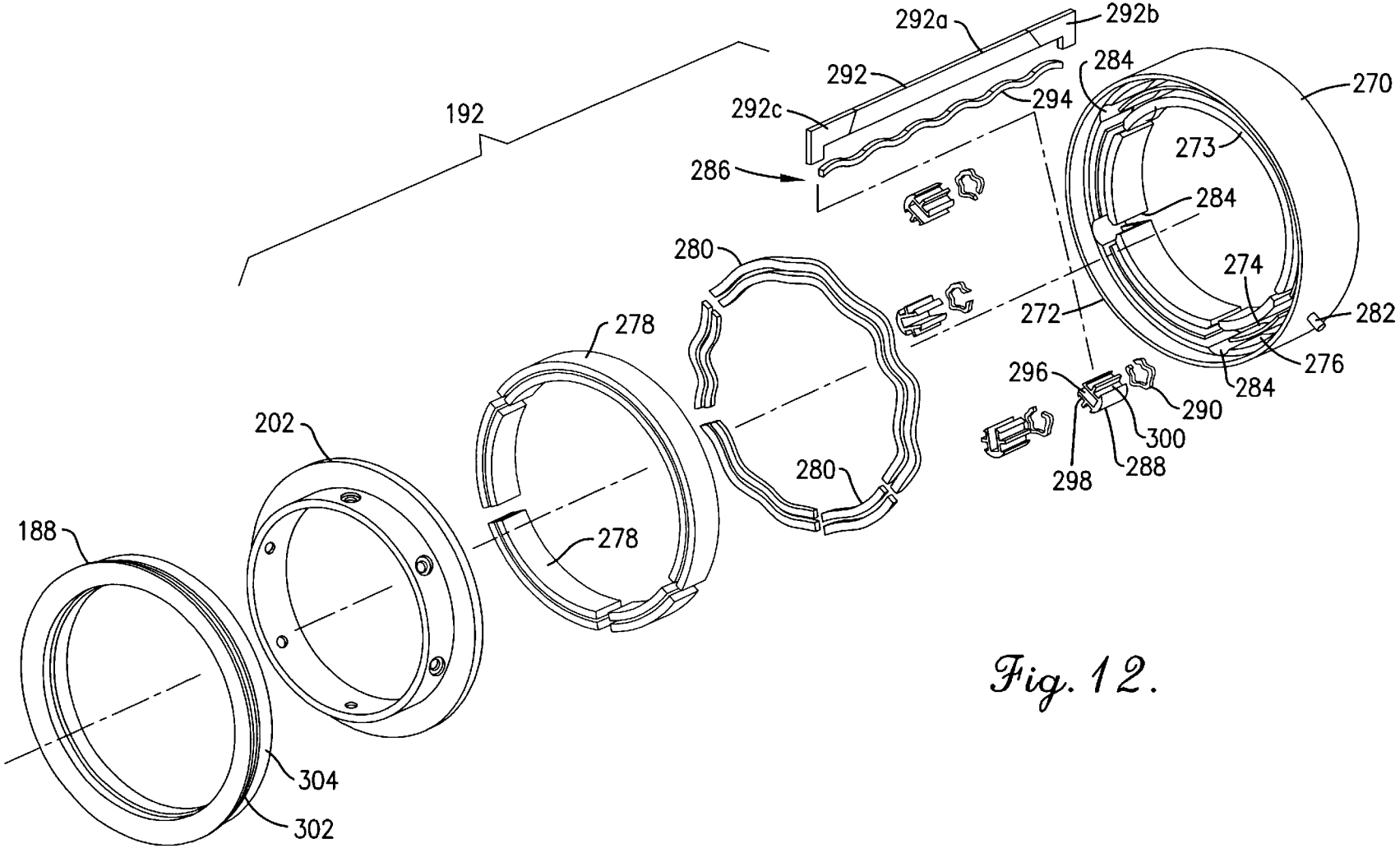
Figure 13:
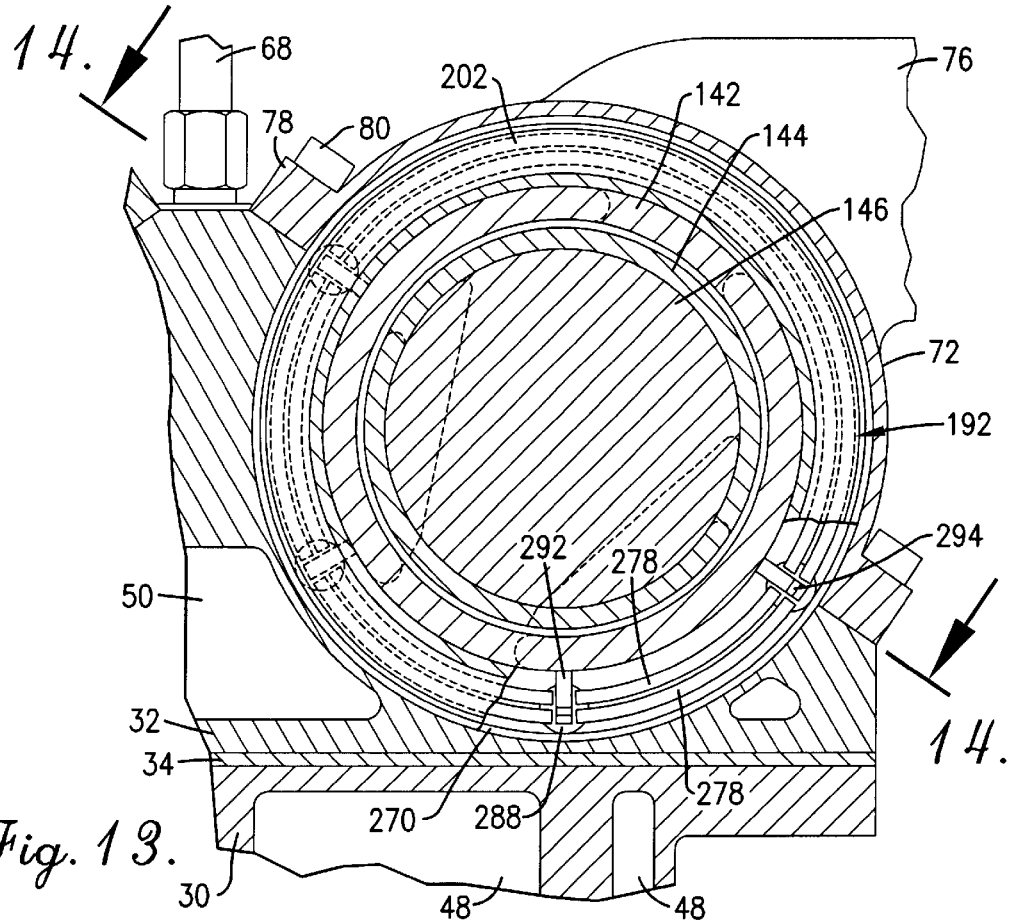
Figure 14:
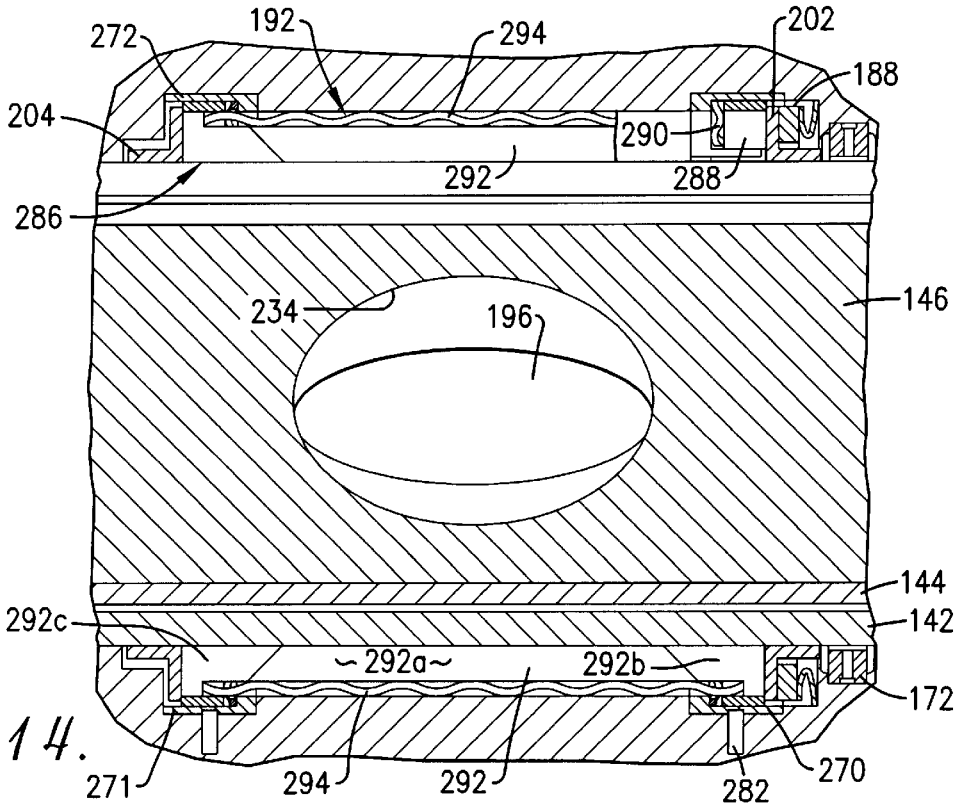

FIG. 5*a* is a fragmentary, relatively enlarged cross-sectional view of the engine similar to FIG. 5, but particularly illustrating portions of the seal and bearing arrangements for the left cylinder shown in FIG. 5;

FIG. 6 is a cross-sectional view of the engine taken generally along line 6—6 of FIG. 2, particularly illustrating the manner in which the valve bearings are preferably lubricated;

FIG. 7 is a cross-sectional view of the engine, particularly illustrating the piston at top dead center between the exhaust and intake strokes;

FIG. 8 is a cross-sectional view of the engine similar to FIG. 7, but illustrating the condition of the cylinder and valve assemblies at the end of the intake stroke with the piston at bottom dead center;

FIG. 9 is a cross-sectional view of the engine similar to FIG. 7, but illustrating the cylinder at top dead center between the compression and firing strokes;

FIG. 10 is a cross-sectional view of the engine similar to FIG. 7, but illustrating the condition of the cylinder and valve assemblies of the beginning of the exhaust stroke with the piston at bottom dead center;

FIG. 11 is a fragmentary, exploded perspective view of the intake valve assembly;

FIG. 11*a* is a fragmentary perspective view of an alternative throttle sleeve design;

FIG. 12 is an exploded perspective view of the rotary valve seal constructed in accordance with the principles of the present invention;

FIG. 13 is a fragmentary cross-sectional view of the engine taken generally along line 13—13 of FIG. 5, particularly illustrating details of construction of the valve seal; and FIG. 14 is a fragmentary cross-sectional view of the engine taken generally along line 14—14 of FIG. 13.

DETAILED DESCRIPTION OF THE PREFERRED EMBODIMENT

Figure 1:
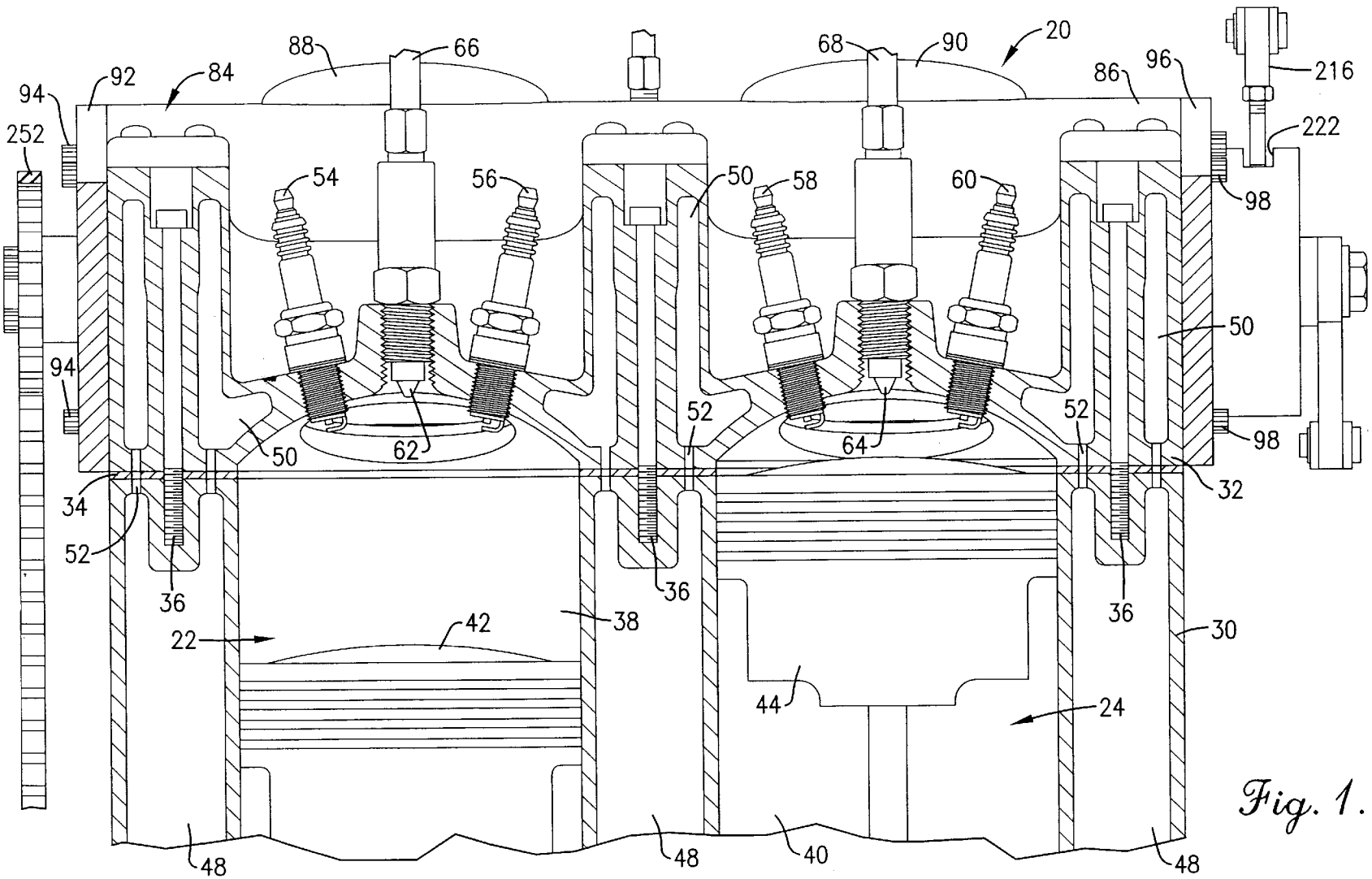
FIG. 1 is a fragmentary cross-sectional view of a two-cylinder internal combustion engine constructed in accordance with the principles of the present invention.

Turning initially to FIG. 1, the reciprocating engine 20 selected for illustration is of the internal combustion variety having two cylinders 22 and 24. As will be described, the present invention particularly concerns the intake valve assembly 26 and the exhaust valve assembly 28 (e.g., see FIGS. 7–10) for controlling fluid flow to and from the cylinders 22 and 24. It is first noted that the principles of the present invention are not limited to the illustrated internal combustion engine 20, but rather it is entirely within the ambit of the present invention to interpose the valve assemblies 26 and 28 along various other flow paths such as the intake and exhaust of a Rankine engine (not shown). Furthermore, the present invention also contemplates various other cylinder configurations. For example, the spirit and scope of the present invention also encompasses single cylinder engines (not shown) or multiple cylinder engines (also not shown) having the cylinders arranged in more than one row (e.g., a V-8 engine) such that an intake valve assembly and an exhaust valve assembly are associated with each cylinder row.

With the foregoing caveat in mind, the illustrated engine 20 includes a block 30, a head 32, a gasket 34 sealing between the block 30 and head 32, and a plurality of screws 36 connecting the head 32 to the block 30 and clamping the gasket 34 therebetween, as is customary. In the usual manner, the block 30 and head 32 cooperatively define the cylindrical internal chambers 38 and 40 of the cylinders 22 and 24, respectively. The engine 20 includes standard pistons 42 and 44, each being conventionally connected to a crankshaft 46 (see also FIG. 6) and oscillating within the respective chamber between top and bottom dead center positions to rotate the crankshaft 46. In the preferred embodiment, the block 30 and head 32 cooperatively form a cooling jacket for each of the cylinders 22 and 24. As perhaps best shown in FIGS. 1, 5 and 6, the block 30 includes multiple cooling passageways 48 and the head 32 includes multiple cooling passageways 50, with the passageways 48 and 50 preferably being interconnected by conduits 52. The passageways 48 and 50 are preferably filled with coolant (e.g., water, antifreeze, combination thereof, etc.) circulating between the engine 20 and a heat exchanger (not shown) such as a radiator.

Each of the cylinders 22 and 24 is preferably provided with a respective pair of spark plugs 54,56 and 58,60, although a single spark plug per cylinder is sufficient. Each of the plugs 54,56 and 58,60 is threadably connected to the head 32 and projects into the respective one of the chambers 38 and 40. In addition, the illustrated engine 20 is particularly configured for electronic fuel injection, with a fuel injector nozzle 62 or 64 being provided in each of the chambers 38 and 40. The injector nozzles 62 and 64 are each threadably connected to the head 32 between the respective pair of spark plugs 54,56 and 58,60. As is customary, each of the nozzles 62 and 64 creates a fine mist fuel spray in the respective one of the chambers 38 and 40, such that the fuel readily and thoroughly mixes with the intake air. The injectors 62 and 64 are preferably connected to a common fuel source (not shown) by fuel lines 66 and 68, respectively. It is noted, however, that the principles of the present invention are equally applicable to various other fuel supply arrangements. For example, it is entirely within the ambit of the present invention to provide the engine 20 with a carburetor (not shown) for mixing the fuel and intake air upstream from the chambers 38 and 40 so that the intake fluid consists of a fuel/air mixture.

An intake manifold 70 for directing intake fluid to the cylinders 22 and 24 is attached to the head 32 (e.g., see FIGS. 6 and 11). The manifold 70 includes a semi-cylindrical cover 72 and a pair of intake pipes 74 and 76. Although not illustrated, an insulating gasket is preferably disposed between the cover 72 and each of the pipes 74 and 76. Those ordinarily skilled in the art will appreciate that such an arrangement likely involves separate pipes fastened to the cover so that the gasket is clamped therebetween. In any case, the pipes 74 and 76 are connected to an air inlet port (not shown) that preferably faces in a forward direction relative to the vehicle propelled by the engine 20, although such an orientation is unnecessary in low-speed vehicles or stationary engine applications. A plurality of attachment ears 78 project from the base of the cover 72, with a pair of bolts 80 projecting through each of the ears 78 and engaging the head 32 so as to attach the manifold 70 to the head 32. Projecting centrally from the cover 72 is a threadably detachable lubricant supply line 82. As will be described, the supply line 82 provides engine oil to the central journal of the intake valve assembly 26. The internal, undersurface of the cover 72 is machined so as to cooperate with the head 32 in containing and supporting the valve assembly 26, as will also subsequently be described.

The engine 20 similarly includes an exhaust manifold 84 (e.g., see FIGS. 2 and 6). The exhaust manifold 84 is essentially identical in construction to the intake manifold 70 and therefore will not be described in detail herein. It is particularly noted that the exhaust manifold 84 preferably includes a gasket (not shown) provided between the exhaust cover 86 and pipes 88 and 90. It will be appreciated that such an insulating gasket is particularly important with respect to the exhaust manifold 84, as it is desirable to maintain the temperature of the pipes 88 and 90 as low as possible. The exhaust manifold 84 also cooperates with the head 32 to contain and support the exhaust valve assembly 28.

It will be appreciated that the head 32 cooperates with the manifolds 70 and 84 to define two generally cylindrical openings in which the valve assemblies 26 and 28 are received. At one end of the head 32 and the manifolds 70 and 84 is a generally flat end plate 92 that covers these valve openings. The plate 92 is preferably fastened to the head 32 and manifolds 70,84 by bolts 94. A uniquely machined end cap 96 is bolted to the opposite end of the head 32 and manifolds 70,84 by fasteners 98 so as to cover the opposite end of the valve openings.

With particular respect to FIGS. 2 and 11, the head 32 presents a surface 100 machined to have a shape matching the various components of the intake valve assembly 26. Particularly, the surface 100 includes a pair of opposite endmost bearing grooves 102 and 104 and four seal flutes 106,108,110,112 spaced therebetween. It is noted that the seal flutes 106 and 108 are associated with the cylinder 22, while the flutes 110 and 112 are associated with the cylinder 24. An anti-rotation channel 114 projects radially from each of the seal flutes 106,108,110,112. Extending between the seal flutes 106 and 108 are four linear, longitudinal seal channels 116 (only three of the seal channels 116 being shown in FIG. 2). There are likewise four longitudinal seal channels 118 extending between the seal flutes 110 and 112. A pair of openings 120 and 122 defined in the head 32 project from the surface 100. The head openings 120 and 122 communicate with the chambers 38 and 40, respectively. Furthermore, the head openings 120 and 122 are located centrally between the respective longitudinal seal channels 116 and 118, such that there are two channels located along each side of each opening. The head openings 120 and 122 are each elliptical in shape with the primary axis extending lengthwise along the head 32. An insert 124 or 126 is preferably provided at the surface 100 in a circumscribing relationship with the respective head opening 120 or 122, as the head 32 and possibly block 30 are formed of Aluminum. The inserts 124 and 126 are preferably formed of graphite but may alternatively be constructed of various other materials (e.g., ceramic, composite, etc.) that provide the desired wear and insulating qualities thereof. Spaced equally between the centermost seal flutes 108 and 110 is a center bearing groove 128 defined in the surface 100. The bearing groove 128 is separated from the seal flutes 108 and 110 by oil seal depressions 130 and 132. It will be appreciated that the surface 100 presents a hemi-circular shape at the grooves 102,104,128, the seal flutes 106,108, 110,112 and the depressions 130,132.

As perhaps best shown in FIG. 5, the cover 72 of the intake manifold 70 presents an interior surface 134 that matches the head surface 100 so as to provide the complement to each the grooves 102,104,128, the seal flutes 106, 108,110,112, the outermost channels 116 and 118, and the depressions 130,132. For example, the interior surface 134 includes a seal flute cooperating with the seal flute 112 on the surface 100 to present a cylindrical opening in which a valve seal is disposed, as will subsequently be described. In addition, the cover 72 includes openings 136 and 138 communicating with the respective one of the intake pipes 74 and 76. It may be said that the interior surface 134 of the cover 72 is similar in all respects to the head surface 100 except the there are no longitudinal seal channels in the surface 134 immediately adjacent the opposite sides of the openings 136 and 138 and the openings 136 and 138 are not each circumscribed by a wear insert. Of course, it is entirely with the ambit of the present invention to alternatively provide the cover surface 134 with these missing features.

The head 32 includes a second, exhaust surface 140 that is a mirror image of the intake surface 100 and similarly cooperates with the exhaust cover 86 to present a number of openings configured to receive various components of the exhaust valve assembly 28. Because of these similarities, the exhaust surface 140 of the head 32 will not be described in detail herein.

Returning to the intake of the engine 20, the intake valve assembly 26 preferably includes an outermost valve body 142, an intermediate throttle sleeve 144 and an innermost core 146, all of which are generally cylindrical in shape and concentric about a common valve axis 148 (see FIG. 11). In the illustrated embodiment the valve body 142 rotates during engine operation to intermittently block intake fluid flow to the cylinders 22 and 24. Additionally, the throttle sleeve 144 is adjustable to vary the time at which the valve is closed, while the core 146 is adjustable to vary the time at which the valve is opened. It will be appreciated, however, that the principles of the present invention are equally applicable to an alternative valve arrangement, wherein the innermost core rotates during engine operation and thereby serves as the valve body and at least one concentric outer sleeve is provided to vary the valve timing.

With particular respect to the illustrated valve body 142, a tubular section 150 projects from a stepped, solid section 152 (see FIGS. 5 and 11). The tubular section 150 presents a distalmost, circumferential, outer recessed surface 154. The recess 154 is in an opposed relationship with the bearing groove 104 and a ball bearing assembly 156 is provided therebetween so as to rotatably support the valve body 142 between the stationary head 32 and intake cover 72. The solid section 152 of the valve body 142 presents a recessed surface 158 that similarly cooperates with the bearing groove 102 to receive a ball bearing assembly 160. The assemblies 156 and 160 may be prepacked with lubricant, flooded with engine oil during engine operation, or otherwise lubricated. The solid section 152 further includes an intermediate recessed surface 162 dimensioned to be received within a corresponding opening in the end plate 92. Finally, the solid section 152 presents a small stub shaft 166 on which a cogged wheel 168 is received. The wheel 168 is preferably fixed to the valve body by fasteners 170 (see also FIG. 3) threadably received in the solid section 152. As will be described, the wheel 168 is part of a belt drive that provides driving power to the valve body 142.

The valve body 142 is preferably also rotatably supported by a central bearing 172 provided at the bearing groove 128. As perhaps best shown in FIGS. 5*a,* 6 and 11, the bearing 172 comprises a split ring having an outer circumferentially extending groove 174 and a plurality of passageways 176 projecting radially from the inner face of the ring to the groove 174. It is noted that the oil supply line 82 is aligned with the bearing groove 128 and thereby the bearing 172. Thus, engine oil is supplied to and floods the bearing 172. As particularly shown in FIGS. 2 and 6, an oil drain opening 178 provided in the head 32 at the bearing groove 128 communicates with a return line 180 defined in the block 30. The return line 180 extends to the oil reservoir 182 defined by the pan 184 of the engine 20. Those ordinarily skilled in the art will appreciate that the oil supply line 82 is connected to a standard oil pump (not shown) so that the bearing 172 is continuously supplied with oil during engine operation. The oil enters the groove 174, passes through the passageways 176, contacts the outer surface of the valve body 142, eventually passes back through the bearing 172 and is discharged through the return line 180. Not only does the oil serve as a lubricant for the bearing 172, it also functions as a coolant for the valve body 142.

As will be described further below, the intake valve assembly 26 is provided with oil seals 186,188 (see FIG. 5) for preventing axial migration of the oil along the length of the valve body 142; that is, the oil is generally contained within the bearing 172. The intake valve assembly 26 further includes a pair of valve seal assemblies 190 and 192, each of which is associated with a respective one of the cylinders 22 and 24. As will also be described further below, each of the seal assemblies 190 and 192 provides a seal between the head 32 and the valve body 142 in a circumscribing relationship with the head openings 120 and 122, respectively.

The tubular section 150 of the valve body 142 presents two pairs of intake holes 194 and 196, with each of the holes 194 and 196 preferably being an ellipse having its primary axis parallel to the valve axis 148. The holes 194 or 196 of each pair are diametrically opposed. The pair of holes 194 is associated with the cylinder 22 and aligned with the head opening 120 and cover opening 136, while the pair of holes 196 are associated with the cylinder 24 and aligned with the head opening 122 and cover opening 138. Furthermore, the holes 194 are offset ninety degrees (90°) relative to the holes 196, and vice versa. As will be indicated further below, such a relationship between the holes is a result of the engine 20 operating as a four cycle engine with the valve body 142 being turned at one-quarter of the speed of the crankshaft 46. Of course, the angular offset of the holes provided in the valve body will vary depending on numerous factors, including the number of cylinders of the engine, the firing order of the cylinders, etc.

It is also noted that four flanges 198,200,202,204 are provided on the outer surface of the tubular section 150 of the valve body 142 (see FIG. 5). Each of the illustrated flanges 198,200,202,204 has a L-shaped cross section and extends continuously and completely around the circumference of the valve body 142. The flanges 198,200,202,204 are preferably attached to the valve body 142 by fasteners that threadably engage the valve body 142 but do not pierce the tubular section 150 thereof. It is noted, however, that the present invention also contemplates providing an alternative valve body having the flanges integrally formed with the tubular section (e.g., by a casting or machining process) so that such attachment is eliminated. Moreover, the flat smooth surfaces of the flanges 198 and 200 are in an opposed relationship and cooperate with the valve seal assembly 190 in providing the desired sealing action. The flanges 202 and 204 are similarly arranged and cooperate with the valve seal assembly 192 in the same manner.

As perhaps best shown in FIG. 5, the valve body 142 is provided with four temperature control grooves 206,208, 210,212 spaced along the inner surface of the tubular section 150. The grooves 206 and 208 are spaced immediately outside the ends of the holes 194, while the grooves 210 and 212 are similarly located relative to the holes 196. It will be appreciated that each of the grooves 206,208,210,212, as a result of the reduced body thickness presented thereby, serves to reduce the propagation of heat along the length of the valve body.

Spaced radially between the valve body 142 and core 146 is the throttle sleeve 144. The throttle sleeve 144 includes a tubular section 214 presenting inner and outer diameters that do not vary along the length of the section; that is, there are preferably no steps or recesses in the tubular section 214. The throttle sleeve 144 further includes a crank 216 projecting radially from one end of the tubular section 214. Spaced along the length of the tubular section 214 are two pairs of intake apertures 218 and 220, with the openings of each of the pairs being generally diametrically opposed. Again, the throttle sleeve 144 does not rotate continuously during engine operation, but rather the sleeve 144 is adjustably positioned (possibly during engine operation) by revolving a limited degree about its longitudinal axis. In this regard, contrary to the ninety degrees (90°) offset of the holes 194 and 196 of the valve body 142, the pairs of apertures 218 and 220 are presented along a common diametrical line of the sleeve 144. For each pair of apertures 218 or 220, the upstream aperture (the upper aperture in FIGS. 7–10) is larger than the downstream aperture (i.e., the upstream aperture extends around a greater portion of the circumference of the sleeve 144 than the downstream aperture). Furthermore, the upstream aperture has a somewhat rectangular shape with orthogonal corners and straight edges, while the downstream aperture is elliptical in shape.

An alternative, but more preferred, throttle sleeve design is shown in FIG. 11*a,* wherein each pair of apertures 218,220 (only the apertures 220 being shown in FIG. 11*a*) is associated with a turbulator. The illustrated turbulator comprises a plurality of spaced apart teeth 231 designed to interfere with flow through the valve passageway in a manner that creates turbulent flow, thereby enhancing fuel and air mixing. In the illustrated embodiment, the sleeve 144 is rotated only in a single direction from the wide open valve condition (i.e., in a counter-clockwise direction when viewing FIGS. 7–10). In other words, one side edge of each of the illustrated downstream apertures does not project into the respective valve passageway during normal operation. It is also noted from FIGS. 7–10 that the edges of each upstream aperture are concealed behind the cove 146 and consequently have little effect on flow through the valve assembly 26. Accordingly, the teeth 231 are preferably provided only along the edges of the downstream apertures that project into the respective valve passageway when the sleeve 144 is out of the wide open condition. It is noted, however, that the principles of the present invention are equally applicable to alternative turbulator designs. For example, the teeth may have various other alternative shapes (e.g., triangular shaped teeth), rather than the illustrated rectangular shape. Furthermore, the teeth need not all be similarly shaped. It is also possible to provide teeth about the entire circumference of one or both of apertures of each pair. Yet further, the turbulator may alternatively or additionally comprise perforations in the sleeve (e.g., the sleeve may alternatively have a mesh-like construction). The turbulator may also be provided on other components of the engine.

The tubular section 214 of the throttle sleeve 144 projects beyond the recess 154 at the end of the valve body 142 and outwardly beyond the head 32. The tubular section 214 is consequently received in the end cap 96, with the crank 216 being shiftably received in a slot 222 of the cap 96. To permit proper assembly of the intake valve assembly 26, the crank 216 is detachable from the tubular section 214. Particularly, the illustrated crank 216 includes a rod 216*a* having opposite threaded ends, one of which is threadably received in a corresponding opening of the tubular section 214. The opposite end of the rod 216*a* is threadably interengaged with a connector 216*b*. The connector 216*b* is fixed in the proper orientation for connection to the sleeve actuator (described below) by a lock nut 216*c*. In this regard, the intake valve assembly 26 may be assembled with the head 32 and intake manifold 70, the end cap 96 is then attached to the head 32 and manifold 70, and the crank 216 is subsequently attached to the tubular section 214.

A ring seal 226 (preferably formed of graphite) and a wavy washer 228 are provided in an internal recess 230 of the end cap 96 (see FIGS. 5*a* and 11), with the washer 228 serving to yieldably press the seal 226 against the end of the valve body 142. The seal 226 is in wiping engagement with the sleeve 144 and therefore seals between the valve body 142 and throttle sleeve 144. The opposite end of the sleeve 144 terminates short of the solid section 152 of the valve body 142, for purposes which will be described.

The core 146 is the radially innermost component of the intake valve assembly 26 and preferably comprises a solid, generally cylindrical body. The core 146 presents two diametrical flow-through openings 232 and 234, each of which is in alignment with the respective one of the pairs of holes 194 and 196 in the valve body 142 and the respective one of the pair of apertures 218 and 220 in the throttle sleeve 144 (see FIGS. 5 and 11). That is, the flow-through opening 232 is associated with the cylinder 22 and the flow-through opening 234 is associated with the cylinder 24. Similar to the holes 194,196 and downstream apertures 218,220, the openings 232,234 are each elliptical in cross-sectional shape. Further, the openings 232,234 each present a frustum shape and taper in a downstream direction. Each of the openings 232 and 234 therefore cooperates with the respective pair of apertures 218 and 220 in converging intake fluid flow. Those ordinarily skilled in the art will appreciate that such an arrangement creates slight compression of the intake fluid. Although the illustrated holes 194,196, apertures 218,220 and openings 232,234 generally correspond in shape and to a lesser degree size, the principles of the present invention are equally applicable to a valve assembly having differently sized and shaped holes, apertures and openings. It is also possible to have the desirable correspondence in the shape and size of the holes, apertures and openings, but rather use a shape other than elliptical (e.g., D-shaped, rectangular having rounded corners, other polygons with rounded corners, etc.).

The core 146 presents a central section 236 in which the openings 232 and 234 are defined, a distal end section 238 that is smaller in diameter than the central section 236, and a proximal end section 240 that projects beyond the end cap 96 and is also smaller than the central section 236. The diameter of the central section 236 is slightly smaller than the inner diameter of the tubular section 214 of the throttle sleeve 144, such that the core 146 is rotatably supported by the sleeve 144.

A bearing 242, preferably formed of graphite, is provided between the recessed distal end section 238 of the core 146 and the tubular section 150 of the valve body 142. The bearing 242 permits relative rotational movement between the valve body 142 and core 146, while supporting the body 142 and core 146 and maintaining their positional relationships. It is noted that the end section 238 projects beyond the adjacent end of the throttle sleeve 144 but terminates short of the solid section 152 of the valve body 142. Furthermore, the adjacent end of the throttle sleeve 144 preferably contacts the bearing 242 so that the bearing 242 functions, at least to some degree, as a seal between the sleeve 144 and core 146.

The central section 236 of the core 146 is coterminous with the adjacent end of the throttle sleeve 144, and the proximal end section 240 projects therefrom and outwardly beyond the end cap 96 (see FIGS. 5 and 5*a*). A crank 244 is received on a small tip 246 of the end section 240 and is fixed relative to the core 146 by a bolt 248 threadably received in the section 240 (see also FIG. 11).

Located in the outermost recess 249 of the end cap 96 is a ring seal 250 and a wavy washer 251 that yieldably presses the ring seal 250 against the adjacent ends of the tubular section 214 of the throttle sleeve 144 and the central section 236 of the core 146. The ring seal 250 is also in wiping engagement with the outer surface of the proximal end section 240. It will be appreciated that the seal 250 prevents fluid leakage into and out of the annular space defined between the tubular section 214 of the throttle sleeve 144 and the central section 236 of the core 146. Similar to the seal 226, the seal 250 is preferably formed of graphite, although other suitable materials may be used.

Figure 3:
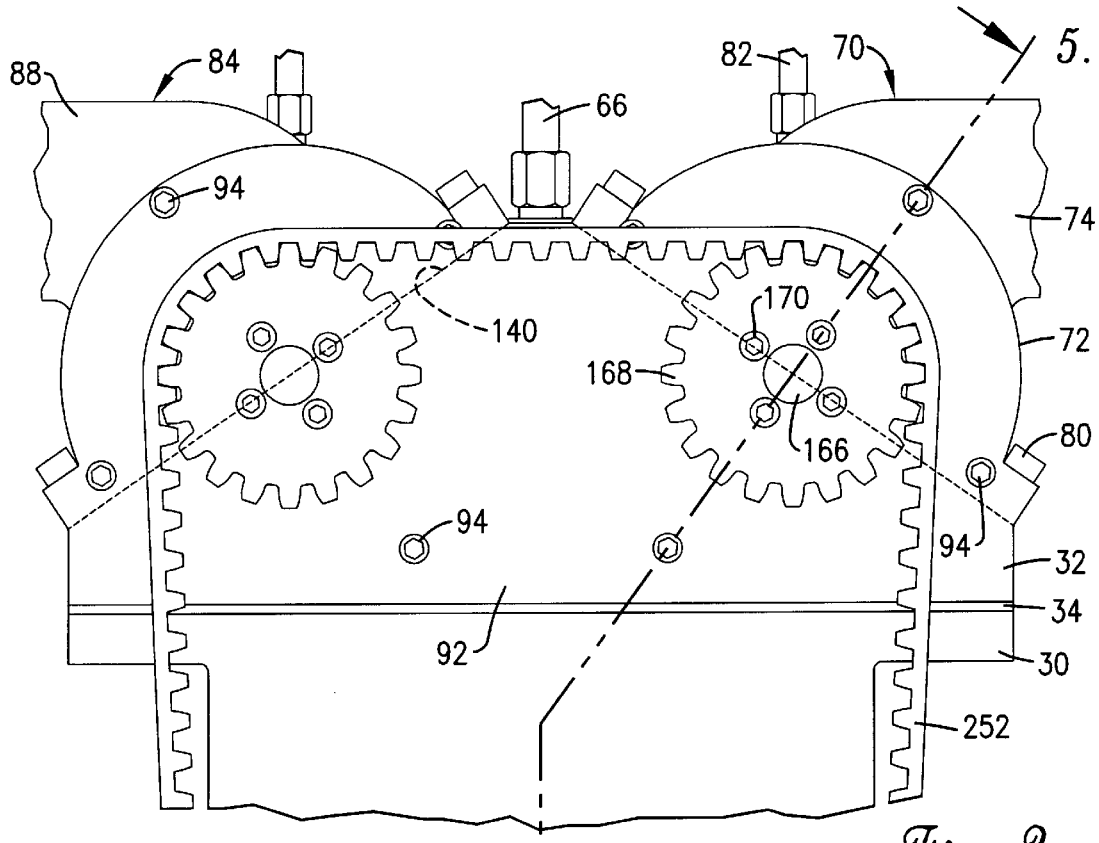
FIG. 3 is fragmentary end elevational view of the engine, particularly illustrating the cogged belt drive for rotating the valve bodies of the intake and exhaust valve assemblies.

Turning to FIGS. 2 and 3, a cogged timing belt 252 entrains a cogged drive wheel 254 fixed to the crankshaft 46 and further loops around the cog wheel 168 fixed to the valve body 142. The valve body 142 is thereby driven in a clockwise direction (when viewing FIGS. 7–10) by the crankshaft 46 and continuously rotated during engine operation. It is particularly noted that, with respect to the illustrated embodiment, the drive wheel 254 is fixed to the crankshaft 46 by a bolt 256 (see specifically FIG. 2). Furthermore, the diametrical dimensions of the drive wheel 254 and driven wheel 168 are proportioned such that the valve body 142 is rotated at one-quarter the speed of the crankshaft 46. In this regard, the valve body 142 permits intake fluid flow to each cylinder during the respective intake stroke of the piston and generally blocks intake fluid flow during the three remaining strokes (i.e., the compression, combustion and exhaust strokes) of the piston. It will be appreciated that the drive belt 252 similarly powers the exhaust valve assembly 28. It is also entirely within the ambit of the present invention to drivingly connect the valve body 142 to the flywheel 258 shown in FIGS. 2 and 6.

Figure 4:
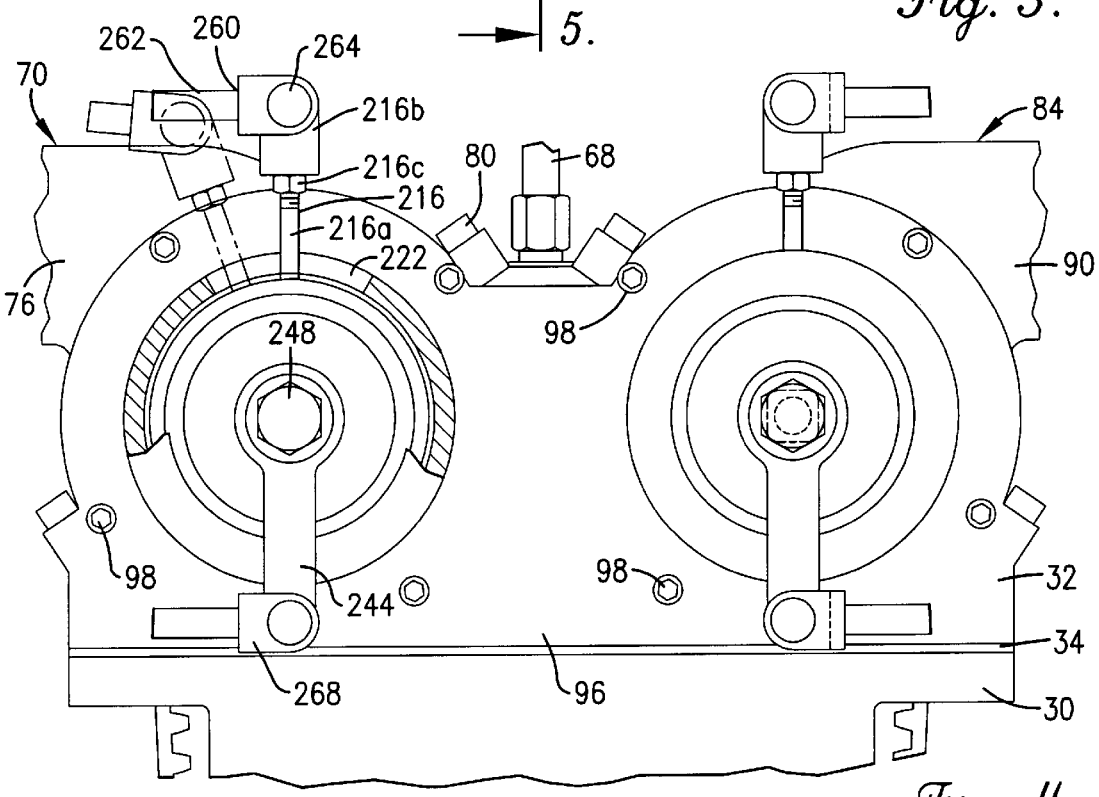
FIG. 4 is a fragmentary elevational view of the end of the engine opposite that shown in FIG. 3, particularly illustrating the controls for the valve timing adjuster.

On the other hand, the throttle sleeve 144 and core 146 do not continuously revolve in a given direction during engine operation, but rather these components are adjustably positioned by rotational movement during engine operation. Moreover, the throttle sleeve 144 and core 146 are not intended to be rotated a complete revolution around the common valve axis 148, nor does the illustrated embodiment permit such rotation. In particular, positioning of the throttle sleeve 144 is controlled by an actuator 260 (e.g., see FIGS. 4 and 11). As perhaps best shown in FIG. 4, the crank 216 of the throttle sleeve 144 is confined within the slot 222, and rotation of the throttle sleeve 144 is thereby limited by the end cap 96. In the illustrated embodiment, the cap 96 serves to limit rotation of the sleeve 144 to approximately seventy-five degrees (75°). Moreover, the illustrated actuator 260 is preferably in the form of a piston and cylinder assembly that is hydraulically or pneumatically operated, although other suitable controls (e.g., a solenoid, another type of linear actuator, etc.) may be used to adjustably position the throttle sleeve 144. As shown in FIG. 11, the illustrated actuator 260 includes a rod 262 pivotally connected to the crank 216 by a pin 264. The cylinder 266 of the actuator 260 is pivotally supported within the engine compartment.

Although the crank 244 for the core 146 is not similarly confined by the end cap 96, an actuator 268 for controlling the positional rotation of the core 146 has operational limitations (i.e., maximum extension and retraction limitations) that effectively confine rotational movement of the core 146. The core actuator 268 is preferably similar to the sleeve actuator 260 and is connected to the crank 244 in the same manner.

The actuators 260 and 268 are preferably remotely controlled by a suitable valve control mechanism (not shown). The control mechanism is preferably responsive to engine operating conditions. Those ordinarily skilled in the art will appreciate that such an arrangement involves on the go adjustment of the position(s) of the sleeve 144 and/or core 146. As will be described further below, the timing of the illustrated intake valve assembly 26 is consequently infinitely variable while the engine 20 is running, thereby optimizing engine operation. In the preferred embodiment, the valve control mechanism automatically operates the actuators 260 and 268. This is preferably accomplished as a result of the control mechanism being operable to sense various operating conditions (e.g., engine speed, cylinder pressure, cylinder temperature, ambient conditions, fuel/air mixture ratio, etc.) and adjust the actuators 260 and 268 responsive thereto. If desired, the valve control mechanism maybe provided with a microprocessor configured to process the signals received from the sensor(s) and prompt adjustment of the actuators 260 and 268. However, the principles of the present invention are equally applicable to a manual valve control mechanism or some combination of manual and automatic controls. For example, the control mechanism may permit the driver to select a driving condition (e.g., performance driving, city driving, highway driving, etc.) and the control mechanism would then adjust the valve timing to that best suited for the selected driving conditions. It may also be desirable to provide a "throttle by wire" mode or controller, wherein the operator's use of the accelerator (e.g., pedal) mechanically controls the position of the control sleeve 144. The use of a maximum power switch is also within the ambit of the present invention. The switch would be activated to override all other sensors coupled to the controller and to shift the sleeve 144 and core 146 to the wide open condition (e.g., see FIGS. 7–9) when the accelerator is moved to full throttle. This would, for example, be helpful in emergency power situations or, in the case of an automobile, during passing.

Turning now to the valve seal assemblies 190 and 192, it is particularly important that a continuous seal be provided between the head 32 and valve body 142 in a circumscribing relationship with the head openings 120 and 122. These seal arrangements must be capable of withstanding the high pressure conditions produced in the cylinders 22 and 24. Of somewhat lesser importance is the continuous seal provided between the intake cover 72 and the valve body 142 in a circumscribing relationship with the intake pipe openings 136 and 138, such that intake fluid is prevented from migrating along the length of the valve assembly 26.

With particular respect to FIGS. 5*a* and 12, the valve seal assembly 192 includes two opposed, circular, circumferential seal carriers 270 and 271, one on each side of the head opening 122. Circumferential seal carriers 270 and 271 mirror each other in construction. Considering seal carrier 270 in detail, it presents a generally E-shaped cross-section, with the outer circumferential projection 272 being slightly longer than the other two inwardly spaced, circumferential projections 273. Thus, the seal carrier 270 presents a pair of annular, circumferential carrier grooves 274 and 276. Seal carrier 270 is dimensioned to be received in seal flute 110, with the open margin of the carrier grooves 274 and 276 facing the flange 202. A segmented circular seal 278 and a segmented wavy washer 280 are located in each of the internal carrier grooves 274 and 276 of the seal carrier 270. Each wavy washer 280 yieldably urges the adjacent circular seal 278 into a sealing relationship with the relatively rotatable flange 202 carried on the valve body 142. The segmented circular seal 278 is preferably formed of graphite but may be constructed of any other suitable material that provides the desired wear and sealing qualities. It will be appreciated that the preferred dual circular seal arrangement provides improved isolation of the high pressures produced in the cylinder compared to a single seal arrangement. However, a single seal arrangement is functional and within the ambit of this invention. An anti-rotation pin 282 projects radially from the outer cylindrical surface of the carrier 270 and is dimensioned to be received in the anti-rotation channel 114, thereby preventing the seal carrier 270 from rotating relative to the head 32 and manifold 70.

As perhaps depicted most clearly in FIG. 12, each segmented circular seal 278 includes four sections, as does each segmented wavy washer 280. Each internal carrier groove 274, 276 is also divided into four segments by four circumferentially spaced slots 284 extending axially through the seal carrier 270. The longitudinal slots 284 are aligned with the longitudinal seal channels 118 in the surface 100. As illustrated in FIGS. 11 and 13, the longitudinal seal channels 118 longitudinally surround the head opening 122. In the preferred embodiment two longitudinal seal channels 118 are in close proximity to the head opening 122, and two are located at the interface of the surface 100 and the interior surface 134, although other spacings are within the spirit of this invention.

Seal carrier 271 is identical in construction to the carrier 270 and is similarly received in the seal flute 112 adjacent flange 204. The carrier 271 will therefore not be described in detail herein.

As shown in FIGS. 12, 13, and 14, the valve seal assembly 192 further includes four identical longitudinal seal assemblies 286. Each longitudinal seal assembly 286 includes a pair of generally U-shaped junction seals 288, a pair of spring washers 290, an elongated longitudinal seal 292, and an elongated longitudinal spring washer 294. The longitudinal seal assemblies 286 extend from flange 202 to flange 204 and are positioned in the longitudinal slots 284 of the seal carriers 270, 271 and the aligned longitudinal seal channels 118. The end of each longitudinal seal and the adjacent end of the corresponding longitudinal spring are snugly received in a longitudinal seal slot 296 of a respective one of the junction seals 288. The spring washer 290 and the junction seal 288, receiving the ends of the respective longitudinal seal and spring washer, are sealingly received in the associated one of the carrier slots 284. As perhaps best shown in FIG. 12, each circumferential side of the junction seal 288 preferably includes two circumferential seal slots 298, 300, each of which firmly and snugly receives the respective one of the seal carrier members 273. The spring washer 290 is positioned between the junction seal 288 and the underlying portion of the seal carrier 270 so as to urge the junction seal sealingly against the rotatable flange 202. Those ordinarily skilled in the art will appreciate that the preferred dual circumferential seal slot arrangement provides improved sealing and stability of the junction seal in the seal carrier. However, a junction seal with only one or even no circumferential seal slot arrangement is envisioned and within the ambit of this invention.

It will be appreciated that small clearances are provided between adjacent surfaces of the circular, junction and longitudinal seals to permit assembly and any necessary movement therebetween. However, such clearances are designed to be so tight that undesirable leakage is prevented, particularly after engine operation when carbon deposits will fill and obstruct any small spaces.

Each longitudinal seal 292 is preferably segmented into three sections, a central section 292*a* and a pair of opposite end sections 292*b* and 292*c* (see FIGS. 12 and 14). The sections 292*a*,292*b*,292*c* cooperatively present a radially outer recess (relative to the valve body 142) in which the washer spring 294 is received. Manifestly, the spring 294 urges all of the sections 292*a*,292*b*,292*c* against the rotating valve body 142, but the spring is preferably also configured to yieldably press the end sections 292*b* and 292*c* into sealing contact with the respective flanges 202 and 204. The sealing contact between the seal 292 and flanges 202 and 204 is further enhanced and maintained during wear by unique, slidable interengagement between the sections 292*a*, 292*b*,292*c* along respective oblique interfaces. That is, such slidable interengagement assists in maintaining effective, long-lasting seals between the elongated longitudinal seal 292 and the valve body 142 and between the ends 296 and flange 202,204, even as the elongated longitudinal seal 292 wears over use. Each oblique interface is defined between the central section 292*a* and the respective one of the end sections 292*b* or 292*c*. The interface extends from the outer surface of the valve body 142 in a direction toward the adjacent end of the longitudinal seal 292. As the seal 292 wears, yieldable urging of the spring 294 against the seal 292 causes the central section 292*a* to progressively push each of the end sections 292*b* and 292*c* against the outer cylindrical surface of the valve body 142 and the respective one of the flanges 202 and 204. Simplified longitudinal seals having a unitary construction, or a single slidable interface between two ends without a separate central section are also within the ambit of this invention.

It is further noted that each longitudinal seal is snugly received in the respective seal channel to reduce the risk of leakage around the backside of each longitudinal seal (i.e., the side of the seal opposite that contacting the valve body 142). Such leakage is further prevented by engagement between the seal and the upstream surface of the seal channel 118 (the surface of the channel spaced furthest from the cylinder). Those ordinarily skilled in the art will appreciate that during high pressure conditions within the cylinder, the seal is pressed against the upstream surface of the channel, thereby blocking airflow.

While the preferred embodiment includes four longitudinal seal assemblies 286, it is possible and within the spirit of this invention to include only two longitudinal seal assemblies surrounding the head opening 122. Those skilled in the art will understand that the seal carrier associated with such an alternative seal assembly would have only two circumferentially spaced juncture slots, and the segmented circular seal would have only three segments, as would the segmented wavy washer.

It will be appreciated that the seal 190 is similar to seal 192. For the sake of brevity, the seal 190 will consequently not be described in detail herein, with the understanding that it is essentially identical in construction to the seal 192.

Oil seals 186, 188 are located between the central bearing 172 and the valve seal assemblies 190, 192 to ensure the oil is maintained in the bearing 172. As each oil seal is virtually a mirror construction of the other, only oil seal 188 will be described in detail. As shown in FIG. 5*a*, the oil seal 188 preferably includes an integrated bellows ring 302 and a backing ring 304. The oil seal 188 is mounted around the L-shaped flange 202 within the depression 132. The backing ring 304 presses against the rotating flange 202, as a result of resilient flexing of the bellows ring 302 between the backing ring and the oil seal depression 132. The bellows ring 312 also insures that any leakage pass the adjacent valve seal assembly 192 is isolated from the bearing lubricant. The oil seals may be constructed from any suitable material such as graphite or ceramic, with due consideration of the sealing requirements and lubricant exposure. The backing ring 304 and the bellows ring 302 may be of differing material to allow proper flexibility of the bellows ring 302.

The operation of the present invention should be apparent from the foregoing description. It shall therefore be sufficient to explain that the rotating valve bodies of the intake and exhaust valve assemblies 26 and 28 block and permit fluid flow into and out of the cylinders 22 and 24 in the usual manner. For example, with respect to the cylinder 24 of the illustrated four-cycle engine 20, the intake valve assembly 26 is open to permit flow of intake air into the cylinder 24 and the exhaust valve assembly 28 is closed to block fluid flow therethrough during the intake stroke. When the piston 44 is at top dead center just before the intake stroke, both valve assemblies 26 and 28 preferably are slightly open although such overlap is not necessary with respect to the principles of the present invention. Intake air entering the chamber 40 therefore facilitates complete removal of exhaust gases. The exhaust valve assembly 28 closes as the piston 44 begins to move downwardly during the intake stroke. Once the piston 44 reaches bottom dead center just before the compression stroke (see FIG. 8), the intake valve assembly 26 is beginning to close and the exhaust valve assembly 28 remains closed. The intake valve assembly 26 closes shortly after the piston 44 reaches bottom dead center, and the exhaust valve assembly 28 remains closed during the compression stroke (see FIG. 9). Both valve assemblies 26 and 28 remain closed during the firing stroke, until just before the piston 44 reaches bottom dead center at which point the exhaust valve assembly 28 begins to open (e.g., see FIG. 10). It will be appreciated that the valve body of each of the assemblies 26 and 28 is turned at one-quarter the speed of the crankshaft 46. Again, the assemblies 26 and 28 are preferably configured so provide open valve overlap during the end of the exhaust stroke and the beginning of the intake stroke (see FIG. 7). That is, the valve assemblies 26 and 28 are preferably both open during this time to assist with the induction of intake air and to facilitate complete discharge of exhaust gases. It is particularly noted that the illustrated embodiment provides such overlap with the throttle sleeves 144 and cores 146 being in the wide open conditions.

The amount of overlap may be varied or altogether eliminated by adjusting the position of the core(s) and/or throttle sleeve(s). Moreover, the illustrated embodiment provides virtually infinite variability of valve timing. It is noted that the valve assemblies 26 and 28 depicted in FIGS. 7–10 are each shown in the wide open condition, expect for the intake valve assembly 26 shown in FIG. 7. As shown in FIG. 7, the throttle sleeve 144 can be rotated counter-clockwise out of the wide open condition to vary the point at which the valve assembly 26 closes. The core 146, on the other hand, can be rotated in the clockwise direction to vary the point at which the valve assembly 26 opens (such rotation also being shown in FIG. 10). Although varying the timing of the exhaust valve assembly 28 is less likely, the illustrated embodiment has provided a throttle sleeve and core to permit such control. In this regard, the exhaust valve assembly may alternatively comprise only a rotatable valve body, a poppet valve, etc. Those ordinarily skilled in the art will further appreciate that the principles of the present invention are equally applicable to various other valve timing controls. For example, the valve assembly may alternatively include an arcuately shaped shutter that moves along a circular path extending around a rotatable valve body, with the shutter cooperating with a fixed or adjustably positioned seat to control valve timing. In any case, the valve assembly most preferably provides a diametrical flow through passageway extending therethrough to intercommunicate the intake (or exhaust) and the chamber.

It is noted that the term "block" as used herein in reference to how the valve assemblies 26 and 28 affect fluid flow to and/or from the cylinder shall be interpreted to mean limiting fluid flow. For example, if the intake valve assembly 26 is spaced from the chamber (rather than being located at the chamber as with the illustrated embodiment) and the valve assembly 26 closes before the piston reaches bottom dead center during the intake stroke, further expansion of the cylinder will likely draw any fluid downstream from the valve into the chamber. Furthermore, the momentum of any fluid downstream from the valve assembly may cause it to flow into the chamber even after the valve closes, notwithstanding the location of the piston. However, the amount of fluid that moves into the chamber after the the valve assembly closes is limited. In the illustrated embodiment with the valve assembly at the chamber (actually defining part of the chamber when closed), intake fluid flow after the valve assembly closes is virtually impossible.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A reciprocating engine comprising:

an engine body presenting an internal chamber and a fluid intake that supplies intake fluid to the chamber;

a piston that oscillates within the chamber during engine operation; and a rotary valve assembly fluidly disposed along the intake so as to generally block intake fluid flow to the chamber when closed and permit intake fluid flow to the chamber when open, said valve assembly including a cylindrical sleeve element presenting diametrically opposed holes, and a cylindrical core element located concentrically within the sleeve, said core element including a diametrically extending surface that defines a diametrical flow-through opening, said holes and opening cooperatively defining, when aligned, a generally linear fluid flow passageway through the valve assembly, said fluid flow passageway being generally aligned with the intake when the valve assembly is open, one of said elements being rotatable during engine operation to intermittently block flow through the passageway and thereby close the valve assembly, said one element being the sleeve, said diametrical surface presenting a frustum shape that tapers in a downstream direction.

2. A rotary valve assembly for controlling fluid flow along the intake or exhaust line of a reciprocating engine, wherein the valve generally blocks fluid flow along the line when closed and permits fluid flow along the line when open, said valve assembly comprising:

a cylindrical sleeve element presenting diametrically opposed holes; and a cylindrical core element located concentrically within the sleeve, said core element including a diametrically extending surface that defines a diametrical flow-through opening, said holes and opening cooperatively defining, when aligned, a generally linear fluid flow passageway through the valve assembly, said fluid flow passageway being generally aligned with the intake when the valve assembly is open, one of said elements being rotatable during engine operation to intermittently block flow through the passageway and thereby close the valve assembly, said one element being the sleeve, said diametrical surface presenting a frustum shape that tapers in a downstream direction.

3. A reciprocating engine comprising:

an engine body presenting an internal chamber and a fluid intake through which fluid flows to the chamber;

a piston that oscillates within the chamber during engine operation; and a rotary valve assembly fluidly disposed along the intake so as to generally block fluid flow to the chamber when closed and permit fluid flow to the chamber when open, said valve assembly including a generally linear fluid flow passageway extending through the valve assembly, with the passageway being generally aligned and communicating with the intake when the valve assembly is open, a rotatable valve body operable to intermittently block fluid flow through the passageway and thereby close the valve assembly as the valve body rotates, and a valve timing adjuster that is shiftable into and out of a variable flow-obstructing relationship with the passageway so as to vary the time during which said valve body blocks flow through the passageway, said valve assembly being located generally at the chamber, said valve body comprising a cylindrical valve sleeve presenting diametrically opposed holes, said valve timing adjuster including a cylindrical core located concentrically within the valve sleeve, said core including a diametrically extending surface that defines a diametrical flow-through opening, said holes and opening cooperatively defining, when aligned, the flow passageway, said diametrical surface presenting a frustum shape that tapers in a downstream direction.

4. A reciprocating engine as claimed in claim 3, said engine body presenting a fluid exhaust through which fluid flows from the chamber; and a second rotary valve assembly fluidly disposed along the exhaust so as to generally block fluid flow from the chamber when closed and permit fluid from the chamber when open.

5. A reciprocating engine as claimed in claim 3, said diametrical holes each being elliptical in shape and said diametrical opening being elliptical in cross-sectional shape.

6. A reciprocating engine comprising:

an engine body presenting an internal chamber and a fluid intake through which fluid flows to the chamber;

a piston that oscillates within the chamber during engine operation; and a rotary valve assembly fluidly disposed along the intake so as to generally block fluid flow to the chamber when closed and permit fluid flow to the chamber when open, said valve assembly including a generally linear fluid flow passageway extending through the valve assembly, with the passageway being generally aligned and communicating with the intake when the valve assembly is open, a rotatable valve body operable to intermittently block fluid flow through the passageway and thereby close the valve assembly as the valve body rotates, and a valve timing adjuster that is shiftable into and out of a variable flow-obstructing relationship with the passageway so as to vary the time during which said valve body blocks flow through the passageway, said valve assembly being located generally at the chamber, said valve body comprising a cylindrical valve sleeve presenting diametrically opposed holes, said valve timing adjuster including a cylindrical core located concentrically within the valve sleeve, said core including a diametrically extending surface that defines a diametrical flow-through opening, said holes and opening cooperatively defining, when aligned, the flow passageway, said rotary valve assembly including a cylindrical throttle sleeve presenting diametrically opposed apertures, said throttle sleeve being concentric with the core and the valve sleeve, with the apertures cooperating with the holes and opening to define the passageway, said throttle sleeve being rotatable into and out of a variable flow-choking relationship with the passageway so as to cooperate with the core in varying the time during which the valve sleeve blocks flow through the passageway.

7. A reciprocating engine as claimed in claim 6, said throttle sleeve being arranged to control when the valve sleeve begins to block flow through the passageway and the core being arranged to control when the valve sleeve stops blocking flow through the passageway.

8. A reciprocating engine as claimed in claim 6, said apertures of the throttle sleeve being in respective upstream and downstream relationships relative to the flow-through opening, said upstream aperture being larger than said downstream aperture.

9. A reciprocating engine an engine body presenting an internal chamber and a fluid intake that supplies intake fluid to the chamber;

a piston that oscillates within the chamber during engine operation; and a rotary valve assembly fluidly disposed along the intake so as to generally block intake fluid flow to the chamber when closed and permit intake fluid flow to the chamber when open, said valve assembly including a cylindrical sleeve element presenting diametrically opposed holes, and a cylindrical core element located concentrically within the sleeve, said core element including a diametrically extending surface that defines a diametrical flow-through opening, said holes and opening cooperatively defining, when aligned, a generally linear fluid flow passageway through the valve assembly, said fluid flow passageway being generally aligned with the intake when the valve assembly is open, one of said elements being rotatable during engine operation to intermittently block flow through the passageway and thereby close the valve assembly, the other of said elements being rotatable into and out of a variable flow-obstructing relationship with the passageway so as to vary the time during which said one of the elements blocks flow through the passageway, said rotary valve assembly including a second cylindrical sleeve element presenting diametrically opposed apertures, said second sleeve element being concentric with the core element and the first-mentioned sleeve element, with the apertures cooperating with the holes and opening to define the passageway, said second sleeve element being rotatable into and out of a variable flow-choking relationship with the passageway so as to cooperate with said other element in varying the time during which said one of the elements blocks flow through the passageway.

10. A reciprocating engine as claimed in claim 9, said second sleeve element being arranged to control when said one element begins to block flow through the passageway and said other element is arranged to control when said one element stops blocking flow through the passageway.

11. A reciprocating engine as claimed in claim 9, said apertures of the second sleeve element being in respective upstream and downstream relationships relative to the flow-through opening, said upstream aperture being larger than said downstream aperture.

12. A reciprocating engine as claimed in claim 9, said diametrical holes each being elliptical in shape and said diametrical opening being elliptical in cross-sectional shape.

13. A rotary valve assembly for controlling fluid flow along the intake or exhaust line of a reciprocating engine, wherein the valve generally blocks fluid flow along the line when closed and permits fluid flow along the line when open, said valve assembly comprising:

a cylindrical sleeve element presenting diametrically opposed holes; and a cylindrical core element located concentrically within the sleeve, said core element including a diametrically extending surface that defines a diametrical flow-through opening, said holes and opening cooperatively defining, when aligned, a generally linear fluid flow passageway through the valve assembly, said fluid flow passageway being generally aligned with the intake when the assembly is open, one of said elements being rotatable during engine operating to intermittently block flow through the passageway and thereby close the valve assembly, the other of said elements being rotatable into and out of a variable flow-obstructing relationship with the passageway so as to vary the time during which said one of the elements blocks flow through the passageway, said rotary valve assembly including a second cylindrical sleeve element presenting diametrically opposed apertures, said second sleeve element being concentric with the core element and the first-mentioned sleeve element, with the apertures cooperating with the holes and opening to define the passageway, said second sleeve element being rotatable into and out of a variable flow-choking relationship with the passageway so as to cooperate with said other element in varying the time during which said one of the elements blocks flow through the passageway.

14. A rotary valve assembly as claimed in claim 13, said second sleeve element being arranged to control when said one element begins to block flow through the passageway and said other element is arranged to control when said one element stops blocking flow through the passageway.

15. A rotary valve assembly as claimed in claim 13, said apertures of the second sleeve element being in respective upstream and downstream relationships relative to the flow-through opening, said upstream aperture being larger than said downstream aperture.

16. A rotary valve assembly as claimed in claim 13, said diametrical holes each being elliptical in shape and said diametrical opening being elliptical in cross-sectional shape.

17. A rotary valve assembly for controlling fluid flow along the intake or exhaust line of a reciprocating engine, wherein a fluid flow opening defined in the rotatable cylindrical outer face of the valve assembly is intermittently aligned with a fluid flow port in an adjacent stationary surface of the engine as the outer face rotates, the improvement comprising:

a pair of flanges extending circumferentially around and projecting radially from the outer face of the valve, said flanges being spaced apart with the fluid flow opening located therebetween;

a pair of elongated longitudinal seals extending longitudinally along the outer face between the flanges and adapted to be generally fixed relative to the stationary surface with the fluid flow port being located therebetween, said longitudinal seals sealingly engaging the outer face and the flanges when fixed relative to the stationary surface; and a pair of arcuately shaped circumferential seals adapted to be fixed relative to the stationary surface, said circumferential seals each sealingly engaging a respective one of the flanges between the longitudinal seals and being sealingly coupled with the longitudinal seals.

18. A rotary valve assembly as claimed in claim 17, each of said longitudinal seals comprising a pair of end sections and a central section, with each end section and the central section interengaging along an oblique wear-accommodating line that extends away from the outer face in a direction toward the adjacent end of the longitudinal seal; and a spring yieldably biasing the longitudinal seal sections toward the outer face so that the center section is sealingly pressed against the outer face and the end sections are each sealingly pressed against the outer face and the respective flange.

19. A rotary valve assembly as claimed in claim 17; and a plurality of juncture seals each sealingly interconnected between a respective one of the longitudinal seals and a respective one of the circumferential seals, such that the seals are cooperatively configured to seal between the outer face and the stationary surface in a circumscribing relationship with the fluid flow port.

20. A rotary valve assembly as claimed in claim 19, each of said circumferential seals comprising arcuate sections, with the arcuate sections being spaced apart to present at least two angularly spaced open gaps, each of said gaps receiving a respective one of the juncture seals therein.

21. A rotary valve assembly as claimed in claim 20, each of said juncture seals including a longitudinal seal slot snugly receiving the respective longitudinal seal therein and a plurality of circumferential seal slots each receiving a respective one of the arcuate sections therein.

22. A rotary valve assembly as claimed in claim 19; and a pair of seal carriers each adapted to be fixed relative to the stationary surface and configured to carry a respective one of the circumferential seals and respective ones of the juncture seals therein.

23. A rotary valve assembly as claimed in claim 22; and at least one spring retained between each carrier and the respective circumferential and juncture seals so as to sealingly press the respective circumferential and juncture seals against the respective flange.

24. A rotary valve assembly as claimed in claim 22, each of said circumferential seals extending at least substantially around the circumference of the outer face, each of said carriers being ring-shaped and presenting an annular seal-receiving groove therein.

25. A reciprocating engine comprising:

a stationary surface presenting a fluid flow port;

a rotary valve assembly operable to generally control flow through the port, said valve assembly presenting a rotatable cylindrical outer face, a fluid flow opening that is defined in the face and intermittently communicates with the port as the outer face rotates, and a pair of radially projecting flanges extending continuously around the face with the opening located therebetween; and a valve seal assembly seal providing sealed communication between the opening and port, said seal assembly including a pair of elongated longitudinal seals extending longitudinally along the outer face between the flanges and generally fixed relative to the stationary surface with the port being located therebetween, said longitudinal seals sealingly engaging the outer face and the flanges, and a pair of arcuately shaped circumferential seals fixed relative to the stationary surface, said circumferential seals each sealingly engaging a respective one of the flanges between the longitudinal seals and being sealingly coupled with the longitudinal seals.

26. A reciprocating engine as claimed in claim 25, each of said longitudinal seals comprising a pair of end sections and a central section, with each end section and the central section interengaging along an oblique wear-accommodating line that extends away from the outer face in a direction toward the adjacent end of the longitudinal seal; and a spring yieldably biasing the longitudinal seal sections toward the outer face so that the center section is sealingly pressed against the outer face and the end sections are each sealingly pressed against the outer face and the respective flange.

27. A reciprocating engine as claimed in claim 25, said valve seal assembly including a plurality of juncture seals each sealingly interconnected between a respective one of the longitudinal seals and a respective one of the circumferential seals, such that the seals cooperatively seal between the outer face and the stationary surface in a circumscribing relationship with the fluid flow port.

28. A reciprocating engine as claimed in claim 27, each of said circumferential seals comprising arcuate sections, with the arcuate sections being spaced apart to present at least two angularly spaced open gaps, each of said gaps receiving a respective one of the juncture seals therein.

29. A reciprocating engine as claimed in claim 28, each of said juncture seals including a longitudinal seal slot snugly receiving the respective longitudinal seal therein and a plurality of circumferential seal slots each receiving a respective one of the arcuate sections therein.

30. A reciprocating engine as claimed in claim 27, said valve seal assembly including a pair of seal carriers each fixed relative to the stationary surface and configured to carry a respective one of the circumferential seals and respective ones of the juncture seals therein.

31. A reciprocating engine as claimed in claim 30, said valve assembly including at least one spring retained between each carrier and the respective circumferential and juncture seals so as to sealingly press the respective circumferential and juncture seals against the respective flange.

32. A reciprocating engine as claimed in claim 30, each of said circumferential seals extending at least substantially around the circumference of the outer face, each of said carriers being ring-shaped and presenting an annular seal-receiving groove therein.

* * * * *